US008267404B2

(12) United States Patent
Grauzer et al.

(10) Patent No.: US 8,267,404 B2
(45) **Date of Patent: *Sep. 18, 2012**

(54) PLAYING CARD SHUFFLER WITH DIFFERENTIAL HAND COUNT CAPABILITY

(75) Inventors: Attila Grauzer, Las Vegas, NV (US); Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 1356 days.

This patent is subject to a terminal disclaimer.

(21) Appl. No.: 11/895,215

(22) Filed: Aug. 23, 2007

(65) Prior Publication Data

US 2007/0290438 A1 Dec. 20, 2007

Related U.S. Application Data

(63) Continuation of application No. 11/057,712, filed on Feb. 14, 2005, now Pat. No. 7,261,294.

(51) Int. Cl.
*A63F 1/12* (2006.01)

(52) U.S. Cl. ..... 273/149 R; 273/149 P

(58) Field of Classification Search ..... 273/149 R, 273/149 P, 148 R

See application file for complete search history.

(56) References Cited

U.S. PATENT DOCUMENTS

| | | | |
|---|---|---|---|
| 793,489 | A | 6/1905 | Williams |
| 1,014,219 | A | 1/1912 | Hall |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,065,824 | A | 12/1936 | Plass |
| 2,778,644 | A | 1/1957 | Stephenson |
| 2,937,739 | A | 5/1960 | Levy |
| 2,950,005 | A | 8/1960 | MacDonald |
| 3,147,978 | A | 9/1964 | Sjöstrand |
| 3,235,741 | A | 2/1966 | Plaisance |
| 3,312,473 | A | 4/1967 | Friedman et al. |
| 3,595,388 | A | 7/1971 | Castaldi |

(Continued)

FOREIGN PATENT DOCUMENTS

EP 0 777 514 6/1997

(Continued)

OTHER PUBLICATIONS

Scarne's Encyclopedia of Games by John Scarne, 1973, "Super Contract Bridge", p. 153.

(Continued)

*Primary Examiner* — William Pierce
(74) *Attorney, Agent, or Firm* — TraskBritt

(57) ABSTRACT

A programmable card handling machine with a display and appropriate inputs for adjusting the machine to any of a number of games comprises inputs including a number of cards-per-hand selector, a card game selector, a number of hands delivered selector and a trouble-shooting input. These features also provide for interchangeability of the machine for many different games, for many types of cards or decks and in different locations thereby reducing the number of back-up machines or units required at a casino. The display may include a game mode or game selected display, and use a cycle rate and/or hand count monitor and display for determining or monitoring usage of the machine. The card handling machine is capable of randomly selecting numbers of cards to be delivered in a hand of cards to players and a dealer during a round of a casino table card game.

20 Claims, 18 Drawing Sheets

U.S. PATENT DOCUMENTS

| | | | |
|---|---|---|---|
| 3,690,670 | A | 9/1972 | Cassady et al. |
| 3,716,238 | A | 2/1973 | Porter |
| 3,897,954 | A | 8/1975 | Erickson et al. |
| 3,944,230 | A | 3/1976 | Fineman |
| 4,159,581 | A | 7/1979 | Lichtenberg |
| 4,232,861 | A | 11/1980 | Maul |
| 4,361,393 | A | 11/1982 | Noto |
| 4,368,972 | A | 1/1983 | Naramore |
| 4,385,827 | A | 5/1983 | Naramore |
| 4,388,994 | A | 6/1983 | Suda et al. |
| 4,397,469 | A | 8/1983 | Carter, III |
| 4,497,488 | A | 2/1985 | Plevyak et al. |
| 4,512,580 | A | 4/1985 | Matviak |
| 4,513,969 | A | 4/1985 | Samsel, Jr. |
| 4,515,367 | A | 5/1985 | Howard |
| 4,534,562 | A | 8/1985 | Cuff et al. |
| 4,566,782 | A | 1/1986 | Britt et al. |
| 4,586,712 | A | 5/1986 | Lorber et al. |
| 4,659,082 | A | 4/1987 | Greenberg |
| 4,667,959 | A | 5/1987 | Pfeiffer et al. |
| 4,741,524 | A | 5/1988 | Bromage |
| 4,750,743 | A | 6/1988 | Nicoletti |
| 4,759,448 | A | 7/1988 | Kawabata |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak et al. |
| 4,876,000 | A | 10/1989 | Mikhail |
| 4,900,009 | A | 2/1990 | Kitahara et al. |
| 4,951,950 | A | 8/1990 | Normand et al. |
| 4,969,648 | A | 11/1990 | Hollinger et al. |
| 5,000,453 | A | 3/1991 | Stevens et al. |
| 5,067,713 | A | 11/1991 | Soules et al. |
| 5,121,921 | A | 6/1992 | Friedman et al. |
| 5,199,710 | A | 4/1993 | Lamle |
| 5,240,140 | A | 8/1993 | Huen |
| 5,261,667 | A | 11/1993 | Breeding |
| 5,275,411 | A | 1/1994 | Breeding |
| 5,288,081 | A | 2/1994 | Breeding |
| 5,303,921 | A | 4/1994 | Breeding |
| 5,356,145 | A | 10/1994 | Verschoor |
| 5,374,061 | A | 12/1994 | Albrecht |
| 5,382,024 | A | 1/1995 | Blaha |
| 5,382,025 | A | 1/1995 | Sklansky et al. |
| 5,390,910 | A | 2/1995 | Mandel et al. |
| 5,431,399 | A | 7/1995 | Kelley |
| 5,437,462 | A | 8/1995 | Breeding |
| 5,584,483 | A | 12/1996 | Sines et al. |
| 5,586,936 | A | 12/1996 | Bennett et al. |
| 5,605,334 | A | 2/1997 | McCrea, Jr. |
| 5,669,816 | A | 9/1997 | Garczynski et al. |
| 5,676,372 | A | 10/1997 | Sines et al. |
| 5,681,039 | A | 10/1997 | Miller |
| 5,683,085 | A | 11/1997 | Johnson et al. |
| 5,690,324 | A | 11/1997 | Otomo et al. |
| 5,692,748 | A | 12/1997 | Frisco et al. |
| 5,695,189 | A | 12/1997 | Breeding et al. |
| 5,707,287 | A | 1/1998 | McCrea, Jr. |
| 5,718,427 | A | 2/1998 | Cranford et al. |
| 5,722,893 | A | 3/1998 | Hill et al. |
| 5,772,505 | A | 6/1998 | Garczynski et al. |
| 5,779,546 | A | 7/1998 | Meissner et al. |
| 5,803,808 | A | 9/1998 | Strisower |
| 5,941,769 | A | 8/1999 | Order |
| 5,944,310 | A | 8/1999 | Johnson et al. |
| D414,527 | S | 9/1999 | Tedham |
| 5,971,849 | A | 10/1999 | Falciglia |
| 5,989,122 | A | 11/1999 | Roblejo |
| 6,019,368 | A | 2/2000 | Sines et al. |
| 6,039,650 | A | 3/2000 | Hill |
| 6,068,258 | A | 5/2000 | Breeding et al. |
| 6,093,103 | A | 7/2000 | McCrea, Jr. |
| 6,110,043 | A | 8/2000 | Olsen |
| 6,117,012 | A | 9/2000 | McCrea, Jr. |
| 6,126,166 | A | 10/2000 | Lorson et al. |
| 6,139,014 | A | 10/2000 | Breeding et al. |
| 6,149,154 | A | 11/2000 | Grauzer et al. |
| 6,165,069 | A | 12/2000 | Sines et al. |
| 6,165,072 | A | 12/2000 | Davis et al. |
| 6,179,291 | B1 | 1/2001 | Vancura |
| 6,217,447 | B1 | 4/2001 | Lofink et al. |
| 6,250,632 | B1 | 6/2001 | Albrecht |
| 6,254,096 | B1 | 7/2001 | Grauzer et al. |
| 6,254,484 | B1 | 7/2001 | McCrea, Jr. |
| 6,257,979 | B1 | 7/2001 | Walker et al. |
| 6,267,248 | B1 | 7/2001 | Johnson et al. |
| 6,270,404 | B2 | 8/2001 | Sines et al. |
| 6,293,546 | B1 | 9/2001 | Hessing et al. |
| 6,299,167 | B1 | 10/2001 | Sines et al. |
| 6,299,536 | B1 | 10/2001 | Hill |
| 6,325,373 | B1 | 12/2001 | Breeding et al. |
| 6,346,044 | B1 | 2/2002 | McCrea, Jr. |
| 6,361,044 | B1 | 3/2002 | Block et al. |
| 6,403,908 | B2 | 6/2002 | Stardust et al. |
| 6,568,678 | B2 | 5/2003 | Breeding et al. |
| 6,569,014 | B2 | 5/2003 | Walker et al. |
| 6,588,750 | B1 | 7/2003 | Grauzer et al. |
| 6,588,751 | B1 | 7/2003 | Grauzer et al. |
| 6,629,894 | B1 | 10/2003 | Purton |
| 6,651,981 | B2 | 11/2003 | Grauzer et al. |
| 6,651,982 | B2 | 11/2003 | Grauzer et al. |
| 6,651,985 | B2 | 11/2003 | Sines et al. |
| 6,655,684 | B2 | 12/2003 | Grauzer et al. |
| 6,659,460 | B2 | 12/2003 | Blaha et al. |
| 6,663,487 | B1 | 12/2003 | Ladner |
| 6,719,288 | B2 | 4/2004 | Hessing et al. |
| 6,722,974 | B2 | 4/2004 | Sines et al. |
| 6,726,205 | B1 | 4/2004 | Purton |
| 2003/0071413 | A1 | 4/2003 | Blaha et al. |
| 2004/0033825 | A1 | 2/2004 | Newton et al. |

FOREIGN PATENT DOCUMENTS

| | | |
|---|---|---|
| WO | WO 87/00764 | 2/1987 |
| WO | WO 98/40136 | 9/1998 |
| WO | WO 00/51076 | 8/2000 |

OTHER PUBLICATIONS

CD Labeled "Shuffler Art". Attached to this 1449 is a spreadsheet having the names of the individual files within the CD. There is a self-executing function on the CD so that, upon entering the Spreadsheet Table of Contents (Index), individual items may be opened directly from the spreadsheet according to the title of the document.

DVD Labeled "Luciano Decl. Ex. K". This is the video taped live Declaration of Mr. Luciano (see list of patents on the 1449 or of record in the file history) taken during preparation of litigation.

DVD Labeled "Solberg Ded. Ex. C". This is the video taped live Declaration of Mr. Solberg, a witness for the defense, taken during preparation for litigation.

DVD labeled Morrill Ded. Ex. A:. This is the video taped live Declaration of Mr. Robert Morrill, a lead trial counsel for the defense, taken during preparation for litigation. He is describing the operation of the Roblejo Prototype device. See Roblejo patent in 1449 or of record.

DVD labeled Exhibit 1. This is a DVD taken by Shuffle Master personnel of the live operation of a CARD One2Six™ Shuffler.

Specification of Australian Patent Application No. 31577/95, filed Jan. 17, 1995, Applicants: Rodney G. Johnson et al., Title: Card Handling Apparatus.

Specification of Australian Patent Application No. Not Listed, filed Aug. 15, 1994, Applicants: Rodney G. Johnson et al., Title: Card Handling Apparatus.

FIG. 2
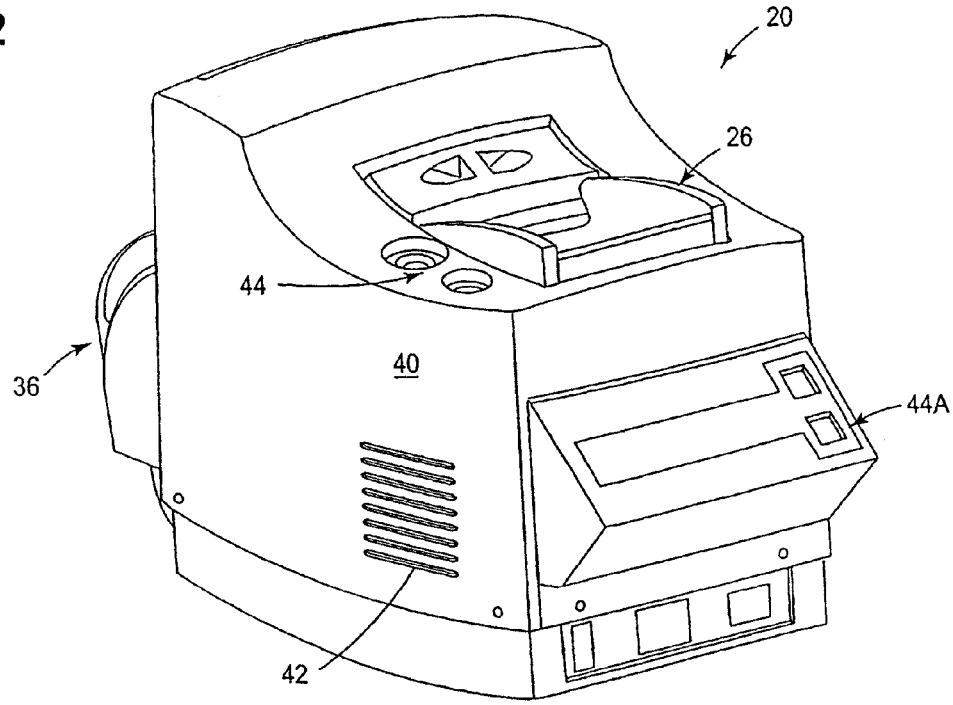
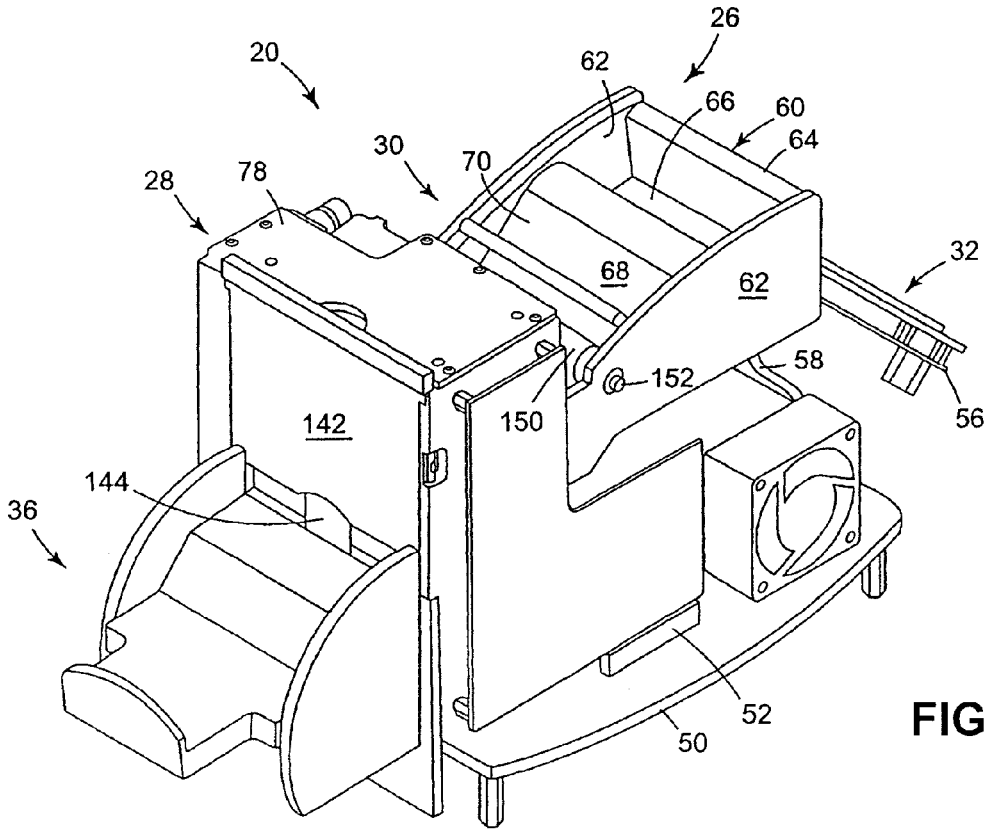
FIG. 3

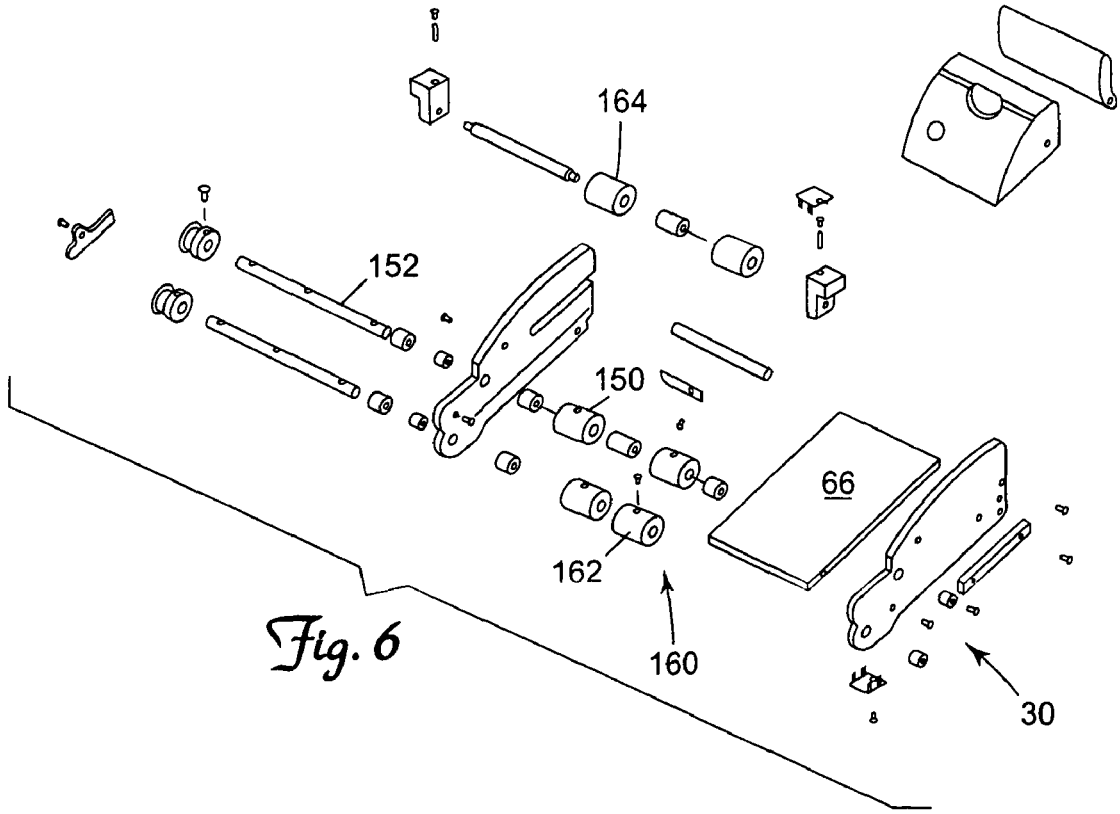
Fig. 6
Fig. 7
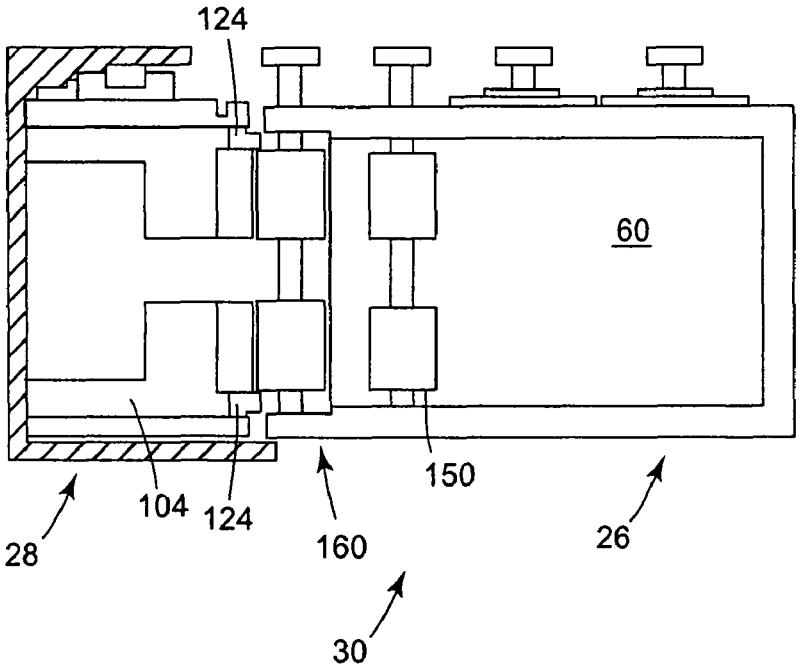

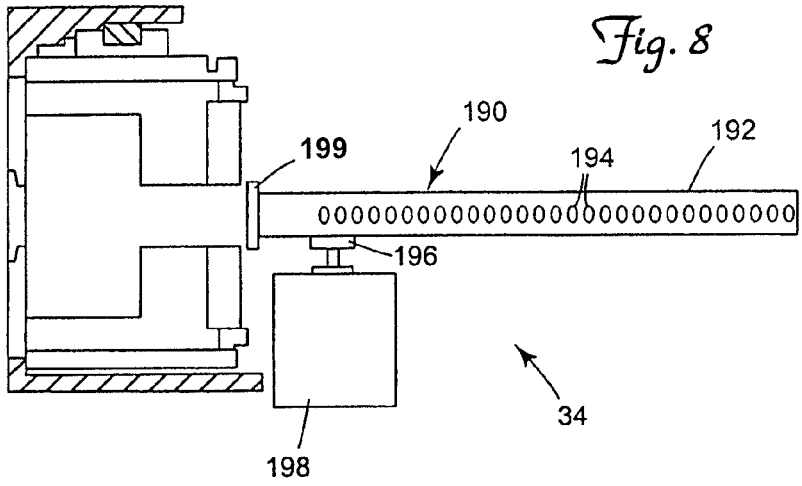
Fig. 8
Fig. 9
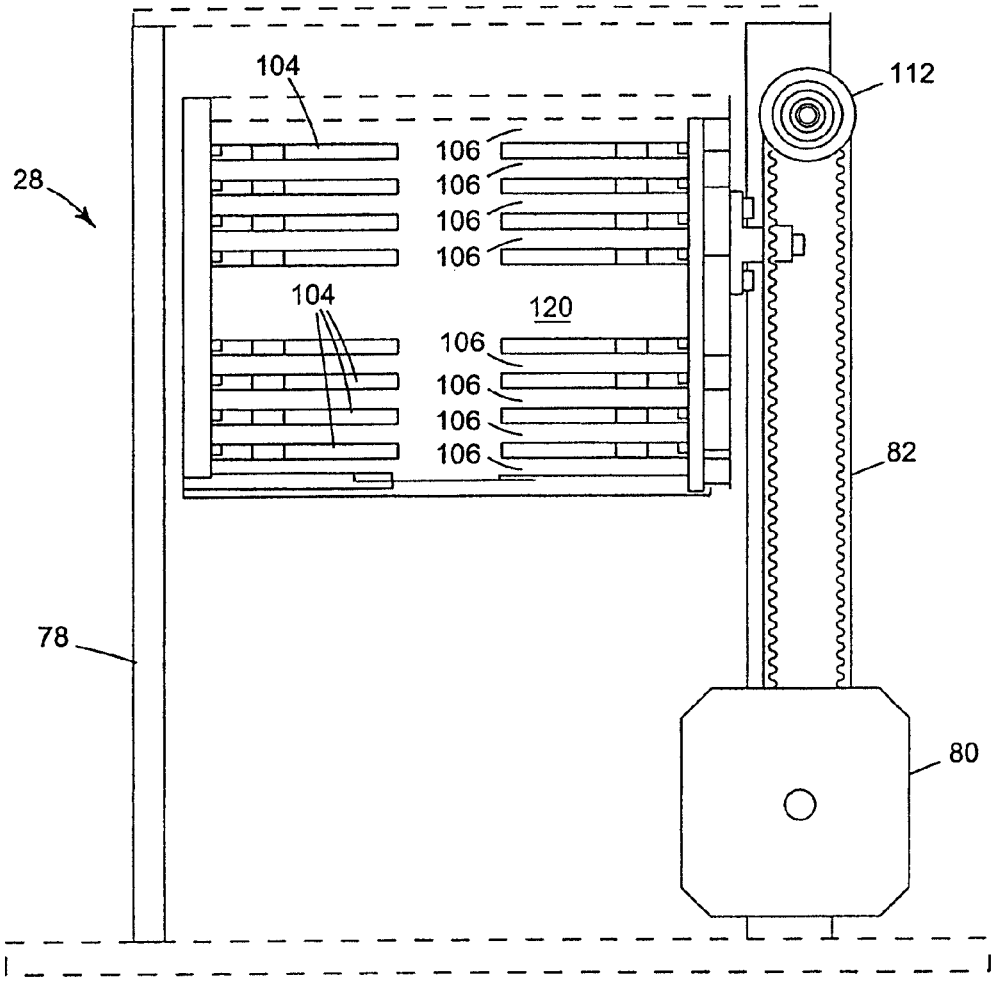

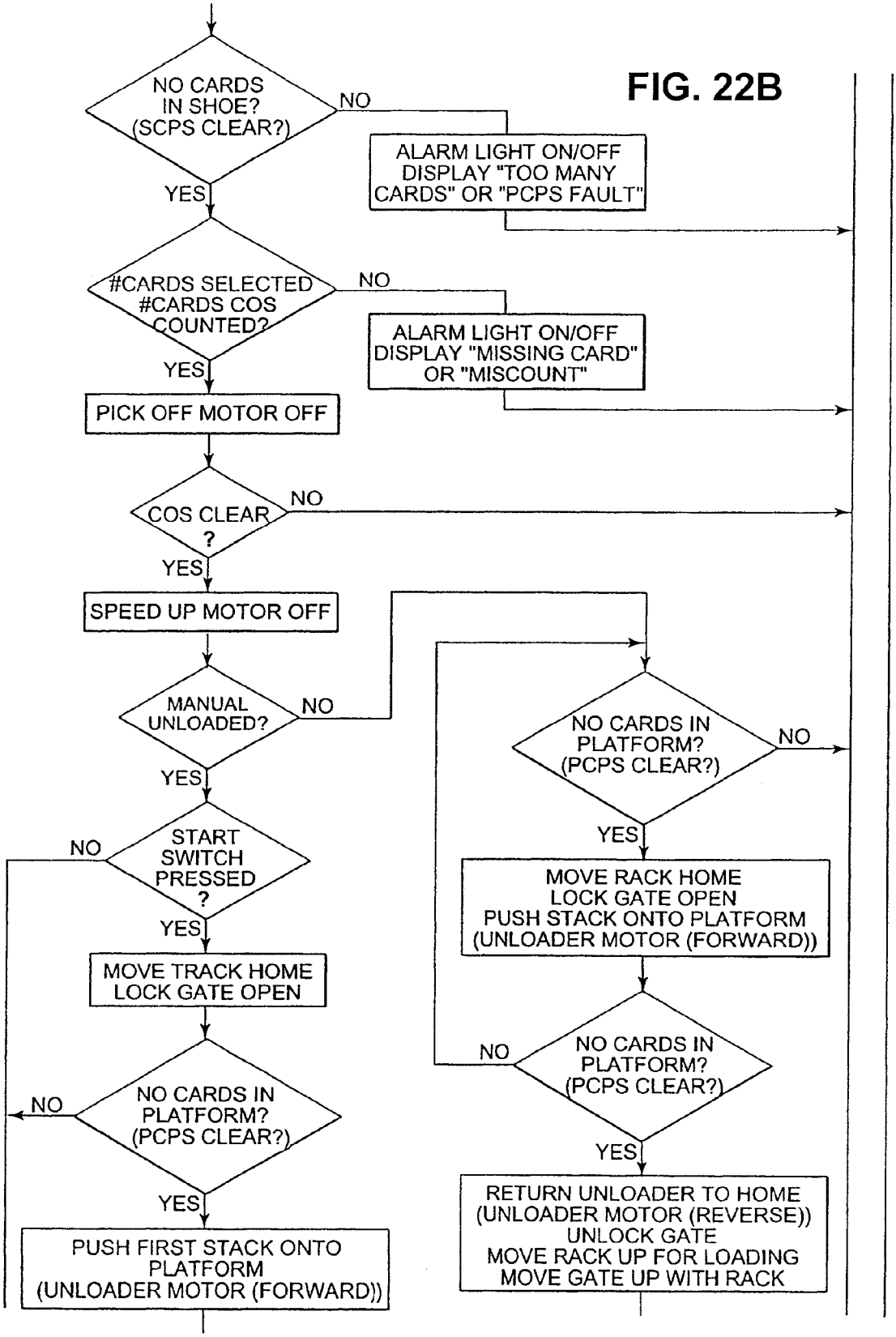
FIG. 22B
NO CARDS IN SHOE? (SCPS CLEAR?)
NO
ALARM LIGHT ON/OFF DISPLAY "TOO MANY CARDS" OR "PCPS FAULT"
YES
#CARDS SELECTED #CARDS COS COUNTED?
NO
ALARM LIGHT ON/OFF DISPLAY "MISSING CARD" OR "MISCOUNT"
YES
PICK OFF MOTOR OFF
COS CLEAR ?
NO
YES
SPEED UP MOTOR OFF
MANUAL UNLOADED?
NO
YES
START SWITCH PRESSED ?
NO
YES
MOVE TRACK HOME LOCK GATE OPEN
NO CARDS IN PLATFORM? (PCPS CLEAR?)
NO
YES
PUSH FIRST STACK ONTO PLATFORM (UNLOADER MOTOR (FORWARD))
NO CARDS IN PLATFORM? (PCPS CLEAR?)
NO
YES
MOVE RACK HOME LOCK GATE OPEN PUSH STACK ONTO PLATFORM (UNLOADER MOTOR (FORWARD))
NO CARDS IN PLATFORM? (PCPS CLEAR?)
NO
YES
RETURN UNLOADER TO HOME (UNLOADER MOTOR (REVERSE)) UNLOCK GATE MOVE RACK UP FOR LOADING MOVE GATE UP WITH RACK

PLAYING CARD SHUFFLER WITH DIFFERENTIAL HAND COUNT CAPABILITY

CROSS-REFERENCE TO RELATED APPLICATION

This application is a continuation of U.S. patent application Ser. No. 11/057,712, filed Feb. 14, 2005, now U.S. Pat. No. 7,261,294, issued Aug. 28, 2007, the disclosure of which is hereby incorporated herein by this reference in its entirety.

TECHNICAL FIELD

The present invention relates to devices for handling cards, including cards known as "playing cards." In particular, the invention relates to an electromechanical card handling machine for organizing, delivering or arranging playing cards into a plurality of hands, wherein each hand is formed as a selected number of randomly arranged cards and different numbers of cards may be provided to different hands on a random basis.

BACKGROUND

Wagering games based on the outcome of randomly generated or selected symbols are well known. Such games are widely played in gaming establishments such as casinos and the wagering games include card games wherein the symbols comprise familiar, common playing cards. Card games such as twenty-one or blackjack, poker and variations of poker and the like are excellent card games for use in casinos. Desirable attributes of casino card games are that the games are exciting, they can be learned and understood easily by players, and they move or are played rapidly to a wager-resolving outcome.

From the perspective of players, the time the dealer must spend in shuffling diminishes the excitement of the game. From the perspective of casinos, shuffling time reduces the number of hands played and reduces the number of wagers placed and resolved in a given amount of time, thereby reducing revenue. Casinos would like to increase the amount of revenue generated by a game without changing games, particularly a popular game, without making obvious changes in the play of the game that affect the hold of the casino, and without increasing the minimum size of wagers. One approach to speeding play is directed specifically to the fact that playing time is decreased by shuffling and dealing events. This approach has led to the development of electromechanical or mechanical card shuffling devices. Such devices increase the speed of shuffling and dealing, thereby increasing playing time. Such devices also add to the excitement of a game by reducing the time the dealer or house has to spend in preparing to play the game.

U.S. Pat. No. 4,513,969 (Samsel, Jr.) and U.S. Pat. No. 4,515,367 (Howard) disclose automatic card shufflers. The Samsel, Jr. patent discloses a card shuffler having a housing with two wells for receiving stacks of cards. A first extractor selects, removes and intermixes the bottommost card from each stack and delivers the intermixed cards to a storage compartment. A second extractor sequentially removes the bottommost card from the storage compartment and delivers it to a typical shoe from which the dealer may take it for presentation to the players. The Howard patent discloses a card mixer for randomly interleaving cards including a carriage supported ejector for ejecting a group of cards (approximately two playing decks in number) which may then be removed manually from the shuffler or dropped automatically into a chute for delivery to a typical dealing shoe.

U.S. Pat. No. 4,586,712 (Lorber et al.) discloses an automatic shuffling apparatus designed to intermix multiple decks of cards under the programmed control of a computer. The Lorber et al. apparatus is a carousel-type shuffler having a container, a storage device for storing shuffled playing cards, a removing device and an inserting device for intermixing the playing cards in the container, a dealing shoe and supplying means for supplying the shuffled playing cards from the storage device to the dealing shoe.

U.S. Pat. No. 5,000,453 (Stevens et al.) discloses an apparatus for automatically shuffling cards. The Stevens et al. machine includes three contiguous magazines with an elevatable platform in the center magazine only. Unshuffled cards are placed in the center magazine and the spitting rollers at the top of the magazine spit the cards randomly to the left and right magazines in a simultaneous cutting and shuffling step. The cards are moved back into the center magazine by direct lateral movement of each shuffled stack, placing one stack on top of the other to stack all cards in a shuffled stack in the center magazine. The order of the cards in each stack does not change in moving from the right and left magazines into the center magazine.

U.S. Pat. No. 3,897,954 (Erickson et al.) discloses the concept of delivering cards one at a time into one of a number of vertically stacked card shuffling compartments. The Erickson patent also discloses using a logic circuit to determine the sequence for determining the delivery location of a card, and that a card shuffler can be used to deal stacks of shuffled cards to a player. U.S. Pat. No. 5,240,140 (Huen) discloses a card dispenser that dispenses or deals cards in four discrete directions onto a playing surface, and U.S. Pat. No. 793,489 (Williams), U.S. Pat. No. 2,001,918 (Nevius), U.S. Pat. No. 2,043,343 (Warner) and U.S. Pat. No. 3,312,473 (Friedman et al.) disclose various card holders, some of which include recesses (e.g., Friedman et al.) to facilitate removal of cards. U.S. Pat. No. 2,950,005 (MacDonald) and U.S. Pat. No. 3,690,670 (Cassady et al.) disclose card sorting devices which require specially marked cards, clearly undesirable for gaming and casino play.

U.S. Pat. No. 4,770,421 (Hoffman) discloses a card shuffling device including a card loading station with a conveyor belt. The belt moves the lowermost card in a stack onto a distribution elevator whereby a stack of cards is accumulated on the distribution elevator. Adjacent to the elevator is a vertical stack of mixing pockets. A microprocessor preprogrammed with a finite number of distribution schedules sends a sequence of signals to the elevator corresponding to heights called out in the schedule. Each distribution schedule comprises a preselected distribution sequence, which is fixed as opposed to random. Single cards are moved into the respective pocket at that height. The distribution schedule is either randomly selected or schedules are executed in sequence. When the microprocessor completes the execution of a single distribution cycle, the cards are removed a stack at a time and loaded into a second elevator. The second elevator delivers cards to an output reservoir. Thus, the Hoffman patent requires a two-step shuffle, i.e., a program is required to select the order in which stacks are loaded and moved onto the second elevator and delivers a shuffled deck or decks. The Hoffman patent does not disclose randomly selecting a location within the vertical stack for delivering each card. Nor does the patent disclose a single stage process, which randomly delivers hands of shuffled cards with a degree of randomness satisfactory to casinos and players. Further, there is no disclosure in the Hoffman patent about how to deliver a preselected number of cards to a preselected number of hands ready for use by players or participants in a game. Another card handling apparatus with an elevator is disclosed in U.S. Pat. No. 5,683,085 (Johnson et al.). U.S. Pat. No. 4,750,743 (Nicoletti) discloses a playing card dispenser including an inclined surface and a card pusher for urging cards down the inclined surface.

Other known card shuffling devices are disclosed in U.S. Pat. No. 2,778,644 (Stephenson), U.S. Pat. No. 4,497,488 (Plevyak et al.), U.S. Pat. Nos. 4,807,884 and 5,275,411 (both Breeding) and U.S. Pat. No. 5,695,189 (Breeding et al.). The Breeding patents disclose machines for automatically shuffling a single deck of cards including a deck-receiving zone, a carriage section for separating a deck into two deck portions, a sloped mechanism positioned between adjacent corners of the deck portions, and an apparatus for snapping the cards over the sloped mechanism to interleave the cards.

The Breeding single deck shufflers used in connection with LET IT RIDE® Stud Poker are programmed to first shuffle a deck of cards, and then sequentially deliver hands of a preselected number for each player. LET IT RIDE® stud poker is the subject of U.S. Pat. Nos. 5,288,081 and 5,437,462 (Breeding), which are herein incorporated by reference. The Breeding single deck shuffler delivers three cards from the shuffled deck in sequence to a receiving rack. The dealer removes the first hand from the rack. Then, the next hand is automatically delivered. The dealer inputs the number of players, and the shuffler deals out that many hands plus a dealer hand. The Breeding single deck shufflers are capable of shuffling a single deck and delivering seven player hands plus a dealer hand in approximately 60 seconds. The Breeding shuffler is a complex electromechanical device, which requires tuning and adjustment during installation. The shufflers also require periodic adjustment. The Breeding et al. device, as exemplified in U.S. Pat. Nos. 6,068,258; 5,695,189; and 5,303,921, is directed to shuffling machines for shuffling multiple decks of cards with three magazines wherein unshuffled cards are cut then shuffled.

U.S. Pat. No. 6,659,460 and U.S. Patent Application Publication 2003/007143A1 disclose a carousel-type card shuffler that forms subgroups of cards in a plurality of compartments. Hands are formed in one compartment or in two compartments. The shuffler can be operated as a continuous shuffler for supplying cards to games such as baccarat and twenty-one, or as a hand-forming shuffler for delivering randomized hands of cards to specialty games such as LET IT RIDE® stud poker, pai gow poker and the like.

U.S. Pat. No. 6,651,981 and U.S. Pat. No. 6,651,982 disclose a card randomizing shuffler that delivers cards to a randomizing chamber. The cards are supported by an elevator and are lifted to a randomly determined height. Stationary gripping arms grasp a portion of the stack, and then the elevator lowers, creating a gap to insert the next card from a feed tray. This structure delivers batches of cards, although it could be programmed to deliver hands.

Although the devices disclosed in the preceding patents, particularly the Breeding machines, provide improvements in card shuffling devices, none discloses or suggests a device and method for providing a plurality of hands of cards, wherein the hands are ready for play and wherein each comprises a randomly selected arrangement of cards, without first randomly shuffling the entire deck. A device and method that provides a plurality of ready-to-play hands of a selected number of randomly arranged cards at a greater speed than known devices without shuffling the entire deck or decks would speed and facilitate the casino play of card games.

SUMMARY OF THE INVENTION

The presently described technology provides an electromechanical card handling apparatus and method for creating or generating a plurality of hands of cards from a group of unshuffled cards wherein each hand contains a predetermined or randomly determined number of randomly selected or arranged cards. The apparatus and, thus, the card handling method or process, is controlled by a programmable microprocessor and may be monitored by a plurality of sensors and limit switches. While the card handling apparatus and method of the present invention is well suited for use in the gaming environment, particularly in casinos, the apparatus and method may find use in homes, card clubs at charitable gaming events and at parties.

In one embodiment, an apparatus provides for moving playing cards from a first group of unshuffled cards into shuffled hands of cards, wherein at least one and usually all of the hands contains a random arrangement or random selection of a preselected number of cards. A random number of cards is provided in at least one hand at some time during one or more rounds of play of a game, and the number of cards, frequency of events, and location of events can be predetermined or randomly determined by operation of software or hardware in the shuffler or associated with the shuffler. One exemplary apparatus comprises a card receiver for receiving the first group of cards, a shuffling mechanism that randomizes the first group of cards into a single batch of randomized cards or into smaller multiple groups of randomized cards (e.g., at least some smaller groups comprise two or more cards, but less than all the cards in the first group of cards), a hand delivery system that delivers groups of at least two cards as hands (although delivery to the tray may be one card at a time) or partial hands to a delivery tray, and a processor that randomly determines that during play of rounds of a game (not necessarily every round, although that is possible), at least one hand or partial hand has a number of cards that differs from a number of cards provided to other hands or partial hands in that same round or in another round of a single game.

Another available feature within the presently described technology is that it provides a programmable card handling machine with a display and appropriate inputs for adjusting the machine to any of a number of games wherein the inputs include a number of cards per hand selector, a card game selector, a number of hands delivered selector and a troubleshooting input. Additionally, when there is an elevator used to assist in card movement, there may be an elevator speed adjustment and sensor to accommodate or monitor the position of the elevator position as cards wear or become bowed or warped. These features also provide for interchangeability of the apparatus, meaning the same apparatus can be used for many different games, for many types of cards or decks and in different locations thereby reducing the number of back-up machines or units required at a casino. The display may include a game mode or game selected display, and use a cycle rate and/or hand count monitor and display for determining or monitoring the usage of the machine.

Another feature of the presently described technology is that it provides an electromechanical playing card handling apparatus for more rapidly generating multiple random hands of playing cards, and for providing the random hands in diverse formats and counts. The preferred device completes a cycle in approximately 30 seconds, which is double the speed of the Breeding single deck shuffler disclosed in U.S. Pat. Nos. 4,807,884 and 5,275,411, which has achieved significant commercial success. Although some of the groups of playing cards (including player and dealer hands and discarded or unused cards) arranged by the apparatus in accordance with the method of the present invention may contain the same number of cards, the cards within any one group or hand are randomized, as by being randomly selected and placed therein or by being selected from a randomized reordered set of playing cards and fed as hands, as cards building a hand one card at a time, or fed to compartments where further randomized sets of cards, including hands, may be formed. Other features of the presently described technology include a reduction of set-up time, increased reliability, lower maintenance and repair costs, and a reduction or elimination of problems such as card counting, possible dealer manipulation and card tracking. These features increase the integrity of a game and enhance casino security.

Yet another feature of the card handling apparatus of the presently described technology is that it converts a single deck or multiple decks of unshuffled cards into a plurality of hands ready for use in playing a game, including games where different numbers of cards can be or are required to be provided to different players' hands or a dealer's hand, even where that different number of cards may be provided randomly to players' or the dealer's hands. The hands converted from the initial deck or decks of cards are substantially completely random, i.e., the cards comprising each hand are randomly selected or provided to be placed into that hand.

To accomplish this random distribution, a preferred, non-limiting embodiment of the apparatus includes a number of vertically stacked, horizontally disposed card receiving compartments one above another into which cards are inserted, one at a time, until an entire group of cards is distributed. In this preferred embodiment, each card receiving compartment is filled (filled to the assigned number of cards for a hand, and with the residue of cards being fed into one or more discard compartments, for example), regardless of the number of players participating in a particular game. For example, when the card handling apparatus is being used for a seven-player game, seven player compartments, a dealer compartment and at least one compartment for cards not used in forming the random hands to be used in the seven-player game are filled. After the last card from the unshuffled group is delivered to a last hand forming compartment still lacking cards, the hands are ready to be removed from the compartments and put into play, either manually, automatically, or with a combined automatic feed and hand removal. In some cases, the discard rack or racks have received all unused cards when hands are unloaded, but in other cases, hands unload before all discards are loaded into the discard rack.

The device can also be readily adapted for games that deal a hand or hands only to the dealer, such as Daniel Jones and David Sklansky's HOLD 'EM CHALLENGE® poker game, described in U.S. Pat. No. 5,382,025.

The device of the presently described technology may include jammed card detection and recovery features, and may include recovery procedures operated and controlled by the microprocessor.

Generally, the operation of card handling apparatuses of prior art shufflers has formed a fixed number of hands of cards corresponding to the maximum number of players at a table, plus a dealer hand (if there is a dealer playing in the game), with each hand being of a specific predetermined number of cards, and usually an equal number of cards, plus a discard pile. For example, U.S. Pat. No. 5,275,411 describes a shuffler and associated devices particularly for use in the play of pai gow poker. The device deals hands of a predetermined number (seven) of cards and then ejects all remaining (four cards, and the deck has 52 cards plus a joker) cards. The patent refers to other devices in patent literature as follows. "U.S. Pat. Nos. 4,513,969 (to Samsel, Jr.) and 4,515,367 (to Howard) disclose automatic card shufflers. The Samsel, Jr. patent discloses a card shuffler having a housing with two wells for receiving two reserve stacks of cards. A first extractor selects, removes and intermixes the bottommost card from each stack and delivers the intermixed cards to a storage compartment. A second extractor sequentially removes the bottommost card from the storage compartment and delivers it to a typical shoe from which the dealer may take it for presentation to the players. The Howard patent discloses a card mixer for randomly interleaving cards including a carriage supported ejector for ejecting a group of cards (approximately two playing decks in number) which may then be removed manually from the shuffler or dropped automatically into a chute for delivery to a typical dealing shoe. Neither of the Samsel, Jr. or Howard patents discloses a dealing module for dealing hands of a predetermined number of cards depending on the rules and procedures of the game being played, and neither discloses a display means for displaying game-related information to players."

U.S. Pat. No. 4,586,712 (to Lorber et al.) discloses an automatic shuffling apparatus directed toward reducing the dead time generated when a casino dealer manually has to shuffle multiple decks of playing cards. The Lorber et al. apparatus has a container, a storage device for storing shuffled playing cards, a removing device and an inserting device for intermixing the playing cards in the container, a dealing shoe and supplying means for supplying the shuffled playing cards from the storage device to the dealing shoe. The dealing shoe is typical, being designed to dispense or allow the dealer to extract and deal one card at a time. The Lorber et al. apparatus is designed to intermix cards under the programmed control of a computer, but does not disclose or suggest how to provide a dealing module for automatically, sequentially dealing or forming hands having a predetermined number of cards or a display means for displaying game-related information to players.

This description is indicative of the fact that many games require precise and regular numbers of cards dealt to specific positions and describes the provision of predetermined numbers of cards to each position (e.g., players, dealer and community cards). U.S. Pat. No. 5,275,411 specifically states that "(a)lthough the devices disclosed in the preceding patents, particularly the Breeding card shuffling machine, provide significant improvements in card shuffling devices, such devices could be improved further if they could be equipped with a dealing module for receiving shuffled cards and for automatically dealing from the shuffled cards a number of hands one after the other, wherein each hand dealt by the module contains a predetermined, selected number of cards. Shuffling machines could also be improved if they could be adapted to facilitate playing a specific game selected from a group of different wagering games, and to display game-related information to the players." This again reinforces the fact that a predetermined and selected number of cards is provided for each hand.

For a typical casino table having seven player stations, some of the devices would preferably have nine compartments (if there are seven players and a dealer) or eight compartments (if there are seven players and no dealer playing in the game), wherein each of seven player compartments contains the same number of cards. Depending upon the nature of the game, the compartments for the dealer hand may have the same or a different number of cards as the seven compartments, and these numbers would be fixed into the program performed by the shuffler, and the discard compartment may contain the same or a different number of cards as the player compartments and/or the dealer compartment, if there is a dealer compartment. Most preferably, the device according to the present technology is programmed to deliver hands until the dealer (whether playing in the game or operating as a house dealer) presses an input button or until the shuffler registers that there are insufficient cards remaining to form a complete hand, or that a predetermined limit of a number of hands has been reached. Any other information or state in the machine indicating that all remaining cards should be removed from the shuffler is also suitably used in the practice of the present technology. The dealer input may tell the microprocessor that the last hand has been delivered (to the players or to the players and dealer), and then the remaining cards in the compartments (excess player compartments and/or discard compartment and/or excess card compartment) will be unloaded into the output or discard compartment. The discard, excess or unused card hand (i.e., the cards placed in the discard compartment or slot) may contain more cards and, thus, the discard compartment may be larger than the other compartments. In a preferred embodiment, the discard compartment is larger than the other compartments and is located in the middle of the generally vertically arranged stack of compartments to minimize travel distances of the rack.

Another feature is that the apparatus of the presently described technology may provide for the initial top feeding or top loading of an unshuffled group of cards, thereby facilitating use by the dealer. The hand receiving portion of the machine may also facilitate use by the dealer, by having cards displayed or provided so that a dealer is able to conveniently remove a randomized hand from the upper portion of the machine or from a tray or platform extending forwardly from the machine or to expose the cards to a vertical or nearly vertical access (within 0° to 30° or 0° to 50° of horizontal, for example) by the dealer's hand.

An additional feature of the card handling apparatus as presently described is that it facilitates and significantly speeds the play of casino wagering games, particularly those games calling for a certain, fixed number of cards per hand (e.g., CARIBBEAN STUD®, LET IT RIDE®, pai gow poker, TRES CARD™ poker, THREE CARD POKER®, HOLD 'EM CHALLENGE® poker, stud poker games and the like, and new games and bonus events in games, or random bonus or play events where random numbers of cards in excess of or less than the standard number of cards are provided to one or more players or a dealer), making the games more exciting and less tedious for players, and more profitable for casinos. The device of the present invention is believed to deliver random hands at an increased speed compared to other shufflers.

In use, the apparatus of the present invention is operated to process playing cards from an initial, unshuffled or previously used group of cards into a plurality of hands, and where each hand (and especially each player hand) enables the provision of hands with different numbers of cards, players' hands with different numbers of delivered cards, and even the random provision of hands with different numbers of cards to players or to dealers, or to players and dealers. The random number may be larger or smaller than the number of cards standardly provided to players and/or dealers.

For example, in a five card stud game, where exactly five cards are dealt and used by players and the dealer, a random number generator may provide six cards to a player or dealer on a random basis or on a set or random frequency (e.g., every ten hands or on a randomly selected number of hands), and/or may provide four cards to a player and/or a dealer on a random basis or on a set or random frequency. It should be understood that the term "unshuffled" is a relative term. A deck is unshuffled a) when it is being recycled after play and b) after previous shuffling before a previous play of a game, as well as c) when a new deck is inserted into the machine without ever having been previously shuffled. The first step of this process is effected by the dealer placing the initial group of cards into the card receiver of the apparatus. The apparatus is started and, under the control of the integral microprocessor, assigns each card in the initial group to a compartment (randomly selecting a compartment for each card), based on the selected number of hands, and a selected number of cards per hand.

Each hand is contained in one or several separate compartments of the apparatus, and each is delivered (upon the dealer's demand or automatically) by the apparatus from that compartment to a hand receiver or platform for the dealer to distribute it to a player. Although in one embodiment a complete hand is formed in a single compartment, more than one compartment can be provided so that a final complete or partial hand is formed (e.g., in a delivery tray) from subgroups of cards formed in two or more compartments. The subgroups are then combined in the delivery tray to form a hand. The number of hands created by the apparatus within each cycle is preferably selected to correspond to the maximum number of hands required to participate in a game (accounting for player hands, dealer hands, or house hands), and the number or quantity of cards per hand is programmable according to the game being played.

Each time a new group of unshuffled cards, hand shuffled cards, used cards or a new deck(s) of cards is loaded into the card receiver and the apparatus is activated, the operation of the apparatus involving that group of cards, i.e., the forming of that group of cards into hands of random cards, comprises a new cycle. Each cycle is unique and is effected by the microprocessor, which microprocessor is programmed with software to include random number generating capability. The software assigns a number to each card and then randomly selects or correlates a compartment to each number. Under the control of the microprocessor, the elevator aligns the selected compartment with the card feed mechanism in order to receive the next card. The software then directs each numbered card to the selected slot by operating the elevator motor to position that slot to receive a card.

The present technology also describes a unique method and component of the system for aligning the feed of cards into respective compartments and for forming groups of randomly arranged cards. The separators between compartments may have an edge facing the direction from which cards are fed, that edge having two acute angled surfaces (away from parallelism with the plane of the separator) so that cards may be deflected in either direction (above/below, left/right, top/bottom) with respect to the plane of the separator. When there are already one or more cards within a compartment, such deflection by the edge of the separator may insert cards above or below the card(s) in the compartment. The component that directs, moves, and/or inserts cards into the compartments may be controllably oriented to direct a leading edge of each card towards the randomly selected edge of a separator so that the card is inserted in the randomly selected compartment and in the proper orientation (above/below, left/right, top/bottom) with respect to a separator, the compartments, and card(s) in the compartments. The addition of the separators to each compartment is believed to increase the randomness in an order of cards within a hand.

The apparatus of the present technology is compact, easy to set up and program and, once programmed, can be maintained effectively and efficiently by minimally trained personnel who cannot affect the randomness of the card delivery. This means that the machines are more reliable in the field. Service costs are reduced, as are assembly costs and set up costs. The preferred device also has fewer parts, which should provide greater reliability than known devices.

Other features and advantages of the present invention will become more fully apparent and understood with reference to the following specification and to the appended drawings and claims.

BRIEF DESCRIPTION OF THE DRAWINGS

FIG. 2 is a rear perspective view depicting the apparatus of the present invention.

FIG. 3 is a front perspective view of the card handling apparatus of the present invention with the exterior shroud removed.

FIG. 6 is an exploded assembly view of the transport mechanism.

FIG. 7 is a top plan view, partially in section, of the transport mechanism.

FIG. 8 is a top plan view of the pusher assembly of the present invention.

FIG. 9 is a front elevation view of a first rack and elevator assembly of the present invention.

FIGS. 22A-22C are flow diagrams depicting a sequence of operation of the present invention.

DETAILED DESCRIPTION OF THE INVENTION

Figure 1:
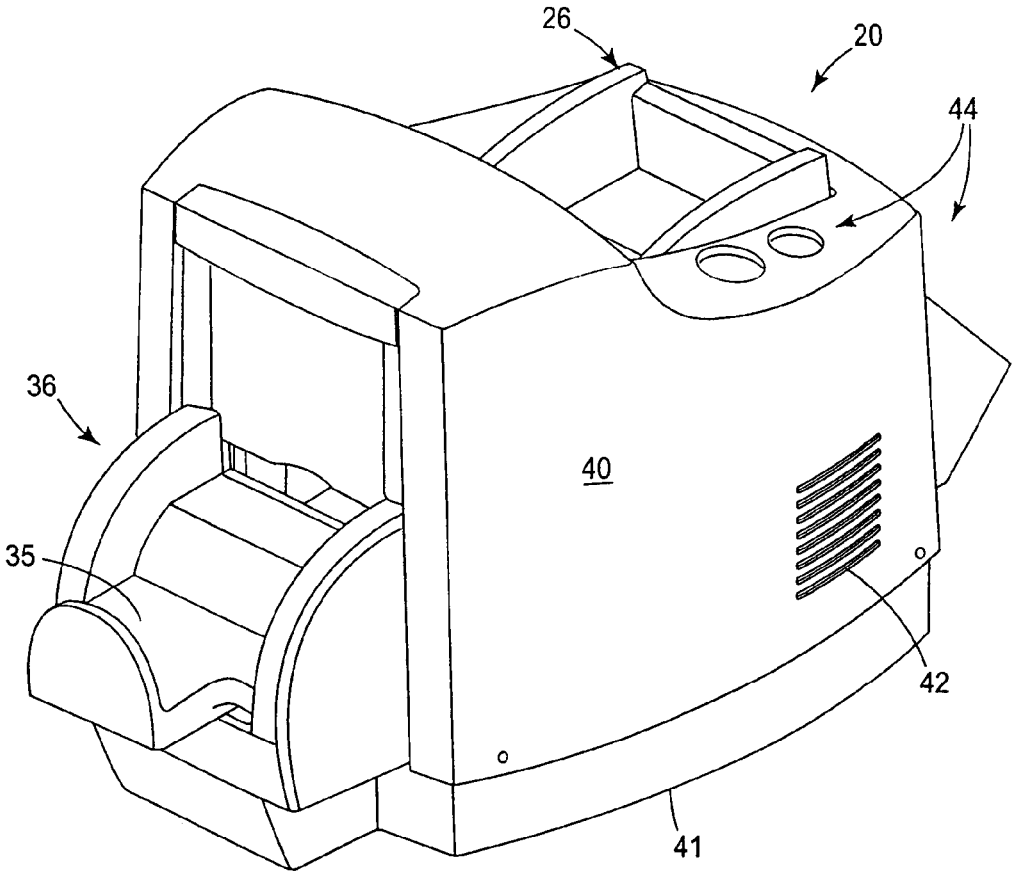
FIG. 1 is a front perspective view depicting the apparatus of the present invention as it might be disposed ready for use in a casino on a gaming table.

This detailed description is intended to be read and understood in conjunction with appended Appendices A, B and C, which are incorporated herein by reference. Appendix A provides an identification key correlating the description and abbreviation of certain non-limiting examples of motors, switches and photoeyes or sensors with reference character identifications of the same components in the figures, and gives the manufacturers, addresses and model designations of certain components (motors, limit switches and sensors). Appendix B outlines steps in a homing sequence, part of one embodiment of the sequence of operations as outlined in Appendix C. With regard to mechanisms for fastening, mounting, attaching or connecting the components of the present invention to form the apparatus as a whole, unless specifically described as otherwise, such mechanisms are intended to encompass conventional fasteners such as machine screws, rivets, nuts and bolts, toggles, pins and the like. Other fastening or attachment mechanisms appropriate for connecting components include adhesives, welding and soldering, the latter particularly with regard to the electrical system of the apparatus.

All components of the electrical system and wiring harness of the present invention may be conventional, commercially available components unless otherwise indicated, including electrical components and circuitry, wires, fuses, soldered connections, chips, boards, microprocessors, computers, and control system components. The software may be developed simply by hired programming without undue experimentation, the software merely directing physical performance of components without unique software functionality (that is, the components are physically moved in a normal manner, but moved to effect different card count results), although unique applications of software are described. For example, random number generation or pseudo-random number generation by software is known in the art, but it has not been heretofore used to randomly determine a) when a number of cards in a hand is to be varied, b) by how many cards (even within fixed parameters) a number of cards in a hand is to be varied from a standard, c) whether a player's hand or a dealer's hand is to be varied, or d) to randomly select between the dealer and the player when a number of cards in a hand is to be varied.

The presently described technology includes a method that may be performed on card shuffling, card randomization or hand forming apparatus. One apparatus of the technology described herein provides hands of playing cards in a casino table card game and may comprise a container for a random group of playing cards; a card moving system for moving playing cards from the random group of playing cards, one playing card at a time to a delivery tray to form a hand of playing cards; and a processor randomly selecting how many playing cards will form a hand in the delivery tray.

At least some of the apparatus within the technology described herein may alternatively or differently be described as an apparatus for providing hands of cards in a casino table card game comprising a container for receiving a first group of cards; a system for forming random subsets of playing cards within the apparatus; a card moving system for moving the random subsets of cards to a delivery tray to form hands of cards; and a processor controlling the card moving system.

The processor may contain a program (in hardware or software) that randomly selects at least one variation from the group consisting of: a) a number of cards in a hand of cards formed in the delivery tray; b) a hand in which a random number of cards will be provided; c) when player hands and a dealer hand are provided, whether a player hand or dealer hand will receive a random number of cards; and d) a frequency at which random numbers of cards will be provided to at least one hand. The processor may randomly select a number of cards from within a defined range that will be provided to at least one hand in the casino table card game. The processor may randomly select a hand that is to contain a random number of cards. The processor may randomly select a hand that is to contain a random number of cards from within a predetermined range of numbers of cards. The apparatus may operate so that only player hands, only dealer's hands, or both players' and dealer's hands, and even community cards may be selected to contain a random number of cards. The processor may be programmed or hard-wired in a wide variety of ways to accomplish delivery of card hands or cards with a randomly determined number of cards in the hand.

Apparatus within the generic concepts described herein may also be described as being for randomizing playing cards and forming hands of playing cards comprising: a receiving area for a first set of playing cards; a randomization area wherein the first set of cards is randomized; a processor for controlling at least the randomization area; and a delivery tray where individual hands of playing cards are delivered or formed as a hand within the delivery tray; wherein the processor randomly selects a number of cards to be delivered or formed within the delivery tray. The apparatus may deliver only player hands, only dealer hands, only community cards or combinations of these hands and groups of cards formed in or delivered to the delivery tray.

A method of providing hands of playing cards for use in a casino table card game may also be practiced on the apparatus. The method may comprise: randomizing a first group of cards within an apparatus; and providing hands of a number of randomized cards for delivery to locations on a casino game table; wherein the number of randomized cards is randomly determined. The method may include determining the number of randomized cards in each hand from within a predetermined range of numbers of cards. The method may include an underlying game play procedure in the casino table card game that is played with players using a specific number of cards to form poker-type hands, and the random number of cards to be determined is selected from the group consisting of the specific number of cards, fewer than the specific number of cards, and more than the specific number of cards. The method may also include an underlying game play procedure in the casino table card game that is played with players using a specific number of cards to form poker-type hands, and the random number of cards to be determined is selected from the group consisting of a) the specific number of cards and b) more than the specific number of cards. The method may be practiced wherein a randomized group of cards is formed within the apparatus and cards are delivered one at a time to the delivery tray to form individual hands, or wherein hands of random cards are formed within the apparatus and the hands of random cards are pushed onto the delivery tray. The groups of cards pushed into the delivery tray (one at a time or in groups) may be complete hands of cards or partial hands of cards.

Generally, unless specifically otherwise disclosed or taught, the materials for making the various components of the present invention are selected from appropriate materials such as metal, metallic alloys, ceramics, plastics, fiberglass, composites and the like.

In the following description, the Appendices and the claims, any references to the terms "right" and "left," "top" and "bottom," "upper" and "lower," and "horizontal" and "vertical" are to be read and understood with their conventional meanings and with reference to viewing the apparatus from whatever convenient perspective is available to the viewer, but generally from the front as shown in the figures.

A method is provided wherein a first group of cards (e.g., usually at least one or exactly one deck of playing cards) is provided (as in a card group input area) for randomization and provision as individual hands or individual partial or "initial" hands of playing cards in a casino table card game, preferably a live casino table card game. The first group of cards is randomized in either forming a randomized group comprising all of the cards in the first group of cards or by forming randomized subgroups of cards, with each subgroup having fewer numbers of cards than the first group of cards. The total number of cards in the subgroups of cards may be equal to the number of cards in the first group, or less than the number of cards in the first group of cards (e.g., with remnant cards, or excess cards not to be used in a game or round of play temporarily retained in a card group input area or moved with or without randomization to a discard or excess card compartment). A program is associated with a processor that controls the card randomization device or system that can be programmed to provide varying numbers of cards in hands to be delivered to players, to dealers, to community cards (e.g., to a flop) or to players and/or dealers. For example, in certain games it may be a feature that where a standard number of cards are usually dealt to a player or dealer (e.g., three cards, four cards, five cards, six cards or seven cards), the program may direct the shuffler to form a single hand with one to seven cards fewer than or greater than the standard number. This would provide a new feature in games, a random number of cards in hands, whether player hands or dealer hands or both. For example, if a game within the genre of five-card stud poker were being played, the random provision of six or seven cards (or any number greater than five cards) to a player would offer an exciting and unexpected, yet anticipated advantage. Similarly, the provision of only three or four cards (or any number less than five cards) to a player would be a temporary disappointment, but part of the anticipation in the play of casino table games. This disappointment could be offset by special bonuses for ranked hands in the hand with fewer cards. For example, in the five-card stud poker game, three-of-a-kind with only three cards might automatically provide a bonus of at least 5:1, 10:1, 20:1 or more (as is more typical in THREE CARD POKER® games), while a bonus award for three-of-a-kind in a five-card poker game is ordinarily only about 3:1.

When the dealer is randomly provided with a number of cards different from the standard number, more cards for the dealer's hand become disadvantageous to the player, and fewer cards can become more advantageous to a player. The rules of the game may or may not allow for five-card flushes and four-card straights to tie five-card hands of equal rank according to other rules of poker (e.g., the highest card in a flush or straight provides the final basis of rank).

A desirable element in this practice of the described technology is assurance of randomness and the lack or predictability in the event of providing and assigning hands of different numbers of cards to players and/or to dealers. This is why some random determination (as with a random number generator, including both hardware and/or software, internal to the shuffler or provided from an external source) of the frequency and position, and even number of cards is desirable. For example, it would be undesirable, but possible, especially where there is a full table (and possibly only where there is a full table) to provide a player hand with a different number of cards every ten hands, or on average every ten hands (or any other specific number). If players know that every tenth hand will have more cards (at a table or for a player), betting strategy would be greatly altered, usually to the disadvantage of the casino. Therefore, randomness may or should be applied to how frequently a different number of cards is to be provided, the number difference that will be available (e.g., in a five-card game, whether 0, 1, 2, 3, 4, 5, 6, 7, 8, or 9 of cards, or fewer or more cards, are to be provided to hands with different number of cards), whether a player or whether a particular player or the dealer, or only among players is to receive the hand with the different number of cards. Once these concepts have been developed and considered as in this patent, the application of random number generation to these features by software and/or hardware can be performed by the skilled artisan.

A method is provided for randomly mixing cards comprising:

a) providing at least one deck of playing cards;

b) removing cards one at a time from the at least one deck of cards;

c) randomly inserting each card removed one at a time into one of a number of distinct storage areas, each storage area defining a distinct subset of cards;

d) randomly determining a number of cards to form at least one distinct subset of cards such that at least one of the storage areas receives at least two randomly inserted cards one at a time to form a random, distinct subset of at least two cards, and the total number of cards within the random, distinct subset of at least two cards was randomly selected from within a range of numbers of cards or parameters.

The terminology "range of parameters" indicates that the selection is not, and cannot be, between zero and infinity in a card game. The uppermost end of the range cannot exceed the total number of cards in the at least one deck, and cannot exceed a number of cards that would prevent other players and a dealer, where present, from receiving a necessary number of cards to play in the underlying card game. For example, with seven players and a dealer in a five-card stud poker game, each player and a dealer may receive five cards, using a total of 40 cards out of the 52 cards in a standard 52-card poker deck. There are still 12 cards available, above the absolutely necessary 40 cards with seven players and a dealer, so the limits on possible numbers of cards within which the number may be randomly chosen are theoretically between zero (cannot deal fewer than zero cards) and 17 cards (the five original cards basic to the game and the 12 remaining cards). It is possible that if more than one hand may be randomly selected within a round of play and fewer than five cards may be dealt, that the range could exceed 17 cards, but the concept of the limits of the range is still clear.

A method is provided for randomly mixing cards comprising:

a) providing at least one deck of playing cards;

b) removing cards one at a time from the at least one deck of cards;

c) randomly inserting each card removed one at a time into one of a number of distinct storage areas, each storage area defining a distinct subset of cards;

d) at least one of the storage areas receiving at least two randomly inserted cards one at a time to form a random, distinct subset of at least two cards, the distinct subset of at least two cards is provided to players or a dealer, and the number of cards in the subset is randomly chosen from within a range of a number of cards.

Cards in random, distinct subsets may removed from at least one of the distinct storage areas. The cards removed from at least one of the distinct storage areas may define a subset of cards that is delivered to a player as a hand. One set of the cards removed from at least one of the distinct storage areas may also define a subset of cards that is delivered to a dealer as a hand. Distinct subsets of cards may be removed from at least one distinct storage area and be delivered into a receiving area. Each distinct subset of cards may be removed from the storage area and delivered to a position on a gaming table that is distinct from a position where another removed subset is delivered. All removed subsets may be delivered to the storage area without removal of previous subsets being removed from the receiving area. At least two received subsets each may become hands of cards for use in a game of cards.

Figure 4:
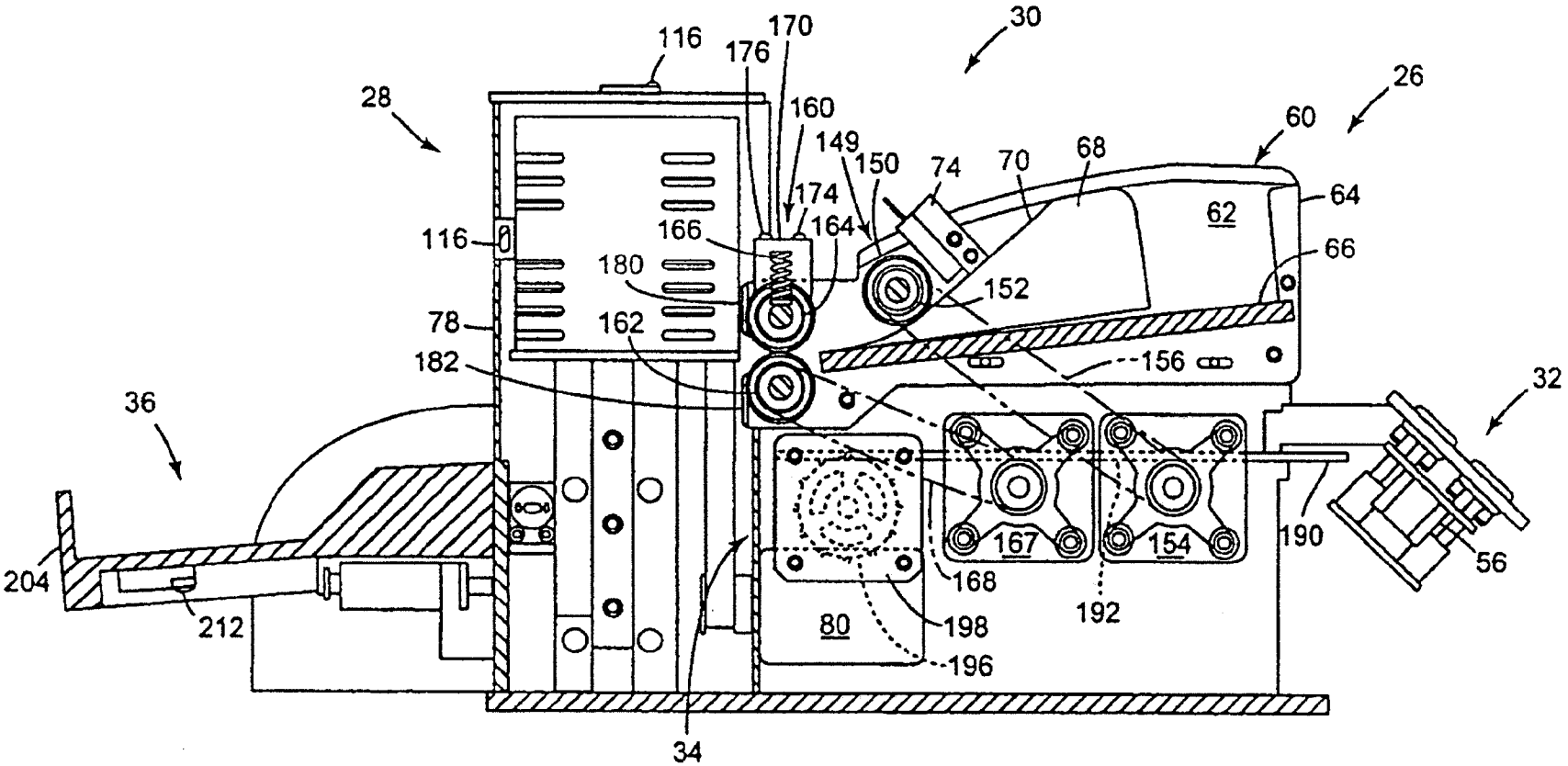
FIG. 4 is a side elevation view of the present invention with the shroud and other portions of the apparatus removed to show internal components.

Referring to the figures, particularly FIGS. 1, 3 and 4, the card handling apparatus 20 of the present invention includes a card receiver 26 for receiving a group of cards, a single stack of card receiving compartments 28 (see FIGS. 3 and 4) generally adjacent to the card receiver 26, a card moving or transporting mechanism 30 between and linking the card receiver 26 and the compartments 28, and a processing unit, indicated generally at 32, that controls the apparatus 20. The apparatus 20 includes a second card moving mechanism 34 (see FIG. 4) for emptying the compartments 28 into a second card receiving platform 36.

Referring now to FIG. 1, the card handling apparatus 20 includes a removable, substantially continuous exterior housing, casing or shroud 40. The exterior design features of the device of the present invention are disclosed in U.S. Design Patent No. D414,527. The shroud or casing 40 may be provided with appropriate vents 42 for cooling, if needed. The card receiver or initial loading region, indicated generally at 26, is at the top, rear of the apparatus 20, and a deck, card or hand receiving platform 36 is at the front of the apparatus 20. The platform 36 has a surface 35 for supporting a deck, card or hand. The surface 35 allows ready access by a dealer or player to the deck, card or hand handled, shuffled or discharged by the apparatus 20. Surface 35, in one example of the present invention, lies at an angle with respect to a base 41 of the apparatus 20. That angle is preferably approximately 5° with respect to the horizontal, but may also conveniently be at an angle of from 0° to up to ±60° with respect to the base 41, to provide convenience and ergonomic considerations to the dealer. Control inputs 44 and/or display features 44A are generally located toward the rear or dealer-facing end of the apparatus 20.

FIG. 2 provides a perspective view of the rear of the apparatus 20 and more clearly shows the display features 44A and control inputs 44, including power input module/switch and a communication port. FIG. 3 depicts the apparatus 20 with the shroud 40 removed, as it might be for servicing or programming, whereby the internal components may be visualized. The apparatus 20 is shown as including a generally horizontal frame floor 50 and internal frame supports for mounting and supporting operational components, such as upright 52. A control (input and display) module 56 is cantilevered at the rear of the apparatus 20, and is operably connected to the operational portions of the apparatus 20 by suitable wiring 58. The inputs 44 and display features 44A of the module 56 are fitted to corresponding openings in the shroud 40, with associated circuitry and programming inputs located securely within the shroud 40 when it is in place as shown in FIGS. 1 and 2.

Card Receiver

The card receiver or card loading region 26 includes a card receiving well 60. The well 60 is defined by upright, generally parallel card guiding sidewalls 62 (although one or both sidewalls 62 may be sloped inwardly to guide the cards into position within the well 60) and a rear wall 64. The card loading region 26 includes a floor surface 66 that, in one example of the present invention, is preferably pitched or angled downwardly toward the front of the apparatus 20. Preferably, the floor surface 66 is pitched from horizontal at an angle ranging from approximately 5 degrees to 20 degrees, with a pitch of about 7 degrees being preferred. A removable, generally rectangular weight or block 68 is generally freely movably received in the well 60 for free forward and rearward movement along the floor surface 66. Under the influence of gravity, the block 68 will tend to move toward the forward end of the well 60. The block 68 has an angled, card contacting front face 70 for contacting the face (i.e., the bottom of the bottommost card) of the last card in a group of cards placed into the well 60, and urges cards (i.e., the top card of a group of cards) forward into contact with the card transporting mechanism 30. The card contacting face 70 of the block 68 is at an angle complimentary to the floor surface 66 of the well 60, for example, an angle of between approximately 10 degrees and 80 degrees, and this angle and the weight of the block keep the cards urged forwardly against the transporting mechanism 30. In one embodiment, card contacting face 70 is rough and has a high coefficient of friction. The selected angle of the floor surface 66 and the weight of the block 68 allow for the free-floating rearward movement of the cards and the block 68 to compensate for the forces generated as the transporting mechanism 30 contacts the front card to move it. In another embodiment, a spring is provided to maintain tension against block 68. As shown in FIG. 4, the well 60 includes a card present sensor 74 to sense the presence or absence of cards in the well 60. Preferably, the block 68 is mounted on a set of rollers 69 (FIG. 5), which allows the block 68 to glide more easily along floor surface 66 and/or the floor surface 66 and floor contacting bottom of the block 68 may be formed of or coated with suitable low-friction materials.

One format of shuffling device, but not the only format of shuffling device, that can be used in the described technology may comprise a generally vertical stack of horizontally disposed card receiving compartments generally adjacent to the card receiver (the vertical stack generally is vertically movable), an elevator for raising and lowering the stack, a card moving mechanism between the card receiver and the stack for moving cards, one at a time, from the card receiver to a selected card receiving compartment, and a microprocessor that controls the card moving mechanism and the elevator so that each card in the group of unshuffled cards is placed randomly into one of the card receiving compartments. Sensors monitor and may trigger at least certain operations of the apparatus, including activities of the microprocessor, card moving mechanisms, security monitoring, and the elevator. The controlling microprocessor, including software, randomly selects or identifies which slot or card receiving compartment will receive each card in the group before card handling operations begin For example, a card designated as card 1 may be directed to a slot 5 (numbered here by numeric position within an array of slots), a card designated as card 2 may be directed to slot 7, a card designated as card 3 may be directed to slot 3, etc.

Card Receiving Compartments

Figure 10:
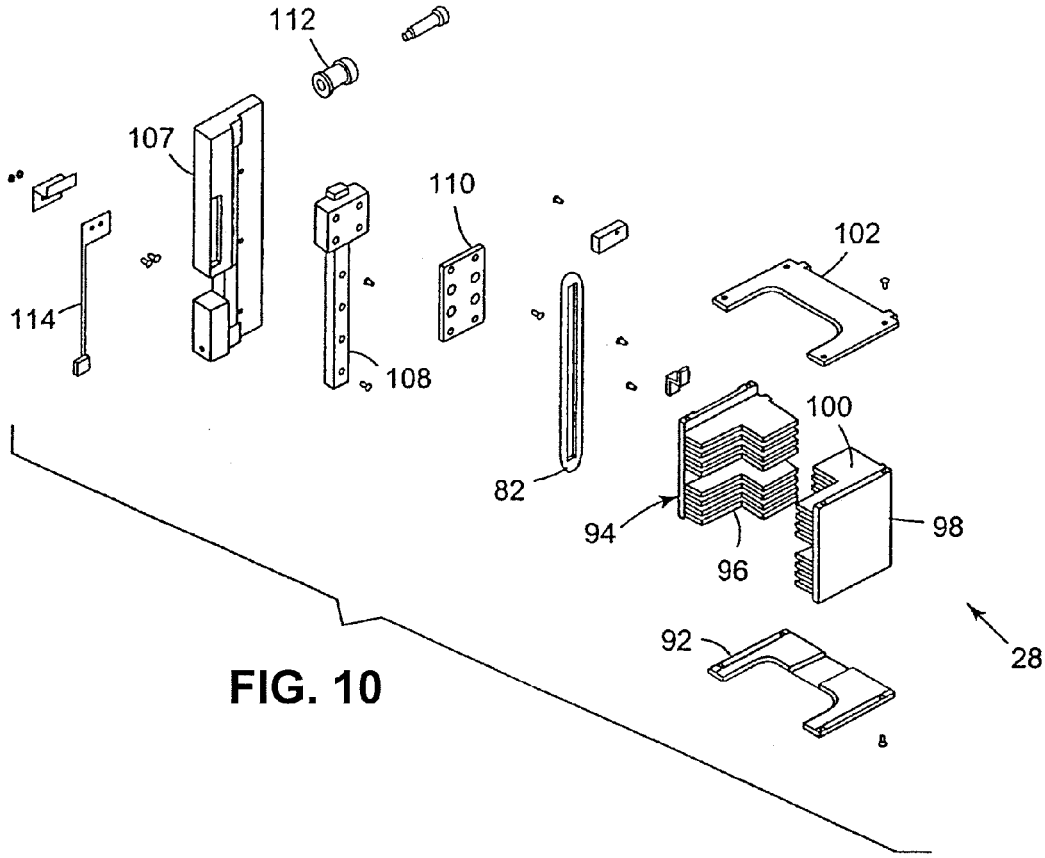
FIG. 10 is an exploded view of the rack and elevator assembly.

A first preferred assembly or stack of card receiving compartments 28 is depicted in FIGS. 9 and 10, and for purposes of this disclosure this stack of card receiving compartments is also referred to as a rack assembly or rack 28. The rack assembly 28 is housed in an elevator and rack assembly housing 78 generally adjacent to the well 60, but horizontally spaced therefrom (see FIG. 4). An elevator motor 80 is provided to position the rack assembly 28 vertically under control of a microprocessor, which microprocessor is generally part of the processing unit 32. The assembly could also be a carousel-type or fan-type compartment assembly. The motor 80 is linked to the rack assembly 28 by a timing belt 82. Referring now to FIG. 10, the rack assembly 28 includes a bottom plate 92, a left-hand rack 94 carrying a plurality of half shelves 96, a right-hand rack 98 including a plurality of half shelves 100 and a top plate 102. Together the right- and left-hand racks 98, 94 and their respective half shelves 100, 96 form individual plate-like shelf pieces 104 for forming the top and bottom walls of individual compartments 106.

Preferably, the rack assembly 28 has nine compartments 106. Seven of the nine compartments 106 are for forming player hands, one compartment 106 forms dealer hands and the last compartment 106 is for accepting unused or discard cards. It should be understood that the device the present invention is not limited to a rack assembly 28 with seven compartments 106. For example, although it is possible to achieve a random distribution of cards delivered to eight compartments with a fifty-two card deck or group of cards, if the number of cards per initial unshuffled group is greater than fifty-two, more compartments than nine may be provided to achieve sufficient randomness in eight formed hands. Also, additional compartments may be provided to form hands for a gaming table having more than seven player positions. For example, some card rooms and casinos offer stud poker games to up to twelve people at a single table. The apparatus may then have thirteen compartments, as traditional poker does not permit the house to play, with one compartment dedicated to collect unused cards.

In each example of the present invention, at least one stack of unused cards is formed, which may not be sufficiently randomized for use in a card game. These unused cards should be returned to the card receiver for distribution in the next cycle.

The rack assembly 28 is operably mounted to the apparatus 20 by a left-side rack plate 107 and a linear guide 108. The rack assembly 28 is attached to the guide 108 by means of a guide plate 110. The timing belt 82 is driven by the motor 80 and engages a pulley 112 for driving the rack assembly 28 up and down. A Hall effect switch assembly 114 is provided to sense the location of the rack assembly 28. The rack assembly 28 may include a card present sensor 116 mounted to an underside of the rack assembly housing 78 (see FIG. 4) and which is electrically linked to the microprocessor.

FIG. 9 depicts a rack assembly 28 having nine individual compartments 106 including a comparatively larger central discard compartment 120 for receiving discard or unused cards. FIG. 7 provides a top plan view of one of the shelf members 104 and shows that each includes a pair of rear tabs 124. The tabs 124 align a leading edge of the card with the opening of the compartment 106 so that the cards are moved from the transporting mechanism 30 into the rack assembly 28 without jamming.

Figure 11:
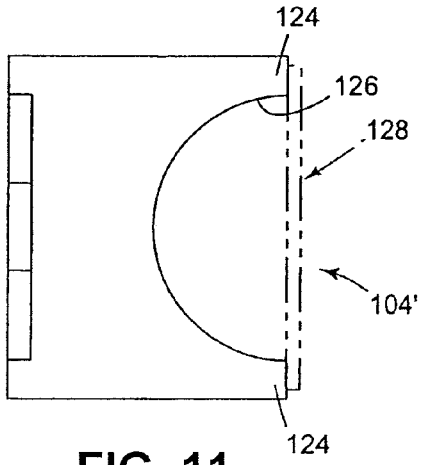
FIG. 11 depicts an alternative embodiment of the shelves or partitions for forming the stack of compartments of the present invention.

FIG. 11 depicts an alternative embodiment of plate-like shelf pieces 104 comprising a single-piece plate member 104'. An appropriate number of the single-piece plate members 104' corresponding to the desired number of compartments 106 are connected between the sidewalls of the rack assembly 28. The plate member 104' depicted in FIG. 11 includes a curved or arcuate edge portion 126 on the rear edge 128 for removing cards or clearing jammed cards, and also includes the two bilateral tabs 124, also a feature of the shelf pieces 104 of the rack assembly 28 depicted in FIG. 7. The tabs 124 act as card guides and permit the plate-like shelf pieces 104 forming the compartments 106 to be positioned effectively as closely as possible to the card transporting mechanism 30 to ensure that cards are delivered into the selected compartment 106 (or 120) even though they may be warped or bowed.

Referring back to FIG. 5, an advantage of the shelf plates 104 (and/or the half shelves 96, 100) forming the compartments 106 is depicted. Each shelf piece 104 includes a beveled or angled underside rearmost surface 130 in the space between the shelf pieces 104, i.e., in each compartment 106, 120. The distance between a forward edge 132 of the beveled surface 130 and a forward edge 134 of a shelf piece 104 preferably is less than the width of a typical card. As shown in FIG. 5A, a leading edge 136 of a card being driven into a compartment 106, 120 hits the beveled surface 130 and is driven onto the top of the stack of cards supported by the next shelf piece 104. As shown in FIG. 5B, when the cards are fully inserted, a trailing edge 133 of each card is positioned between adjacent forward edges 132. To facilitate forming a beveled surface 130 at a suitable bevel angle 135 and of a suitable size, a preferred thickness 137 for the plate-like shelf pieces 104 is approximately 3/32 of an inch, but this thickness 137 and/or the bevel angle 135 can be changed or varied to accommodate different sizes of cards, such as poker and bridge cards. Preferably, the bevel angle 135 is between 10 degrees and 45 degrees, and most preferably between approximately 15 degrees and 20 degrees. Whatever bevel angle 135 and thickness 137 are selected, it is preferred that cards should come to rest with their trailing edges 133 rearward of the forward edge 132 of the beveled surface 130 (see FIG. 5).

Figure 12:
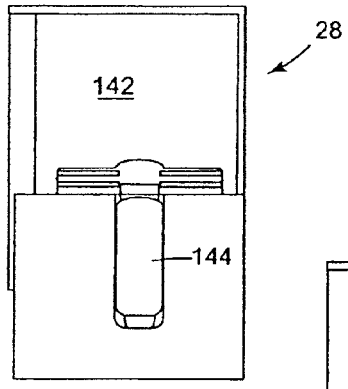
FIG. 12 depicts the card stop in an open position.
Figure 13:
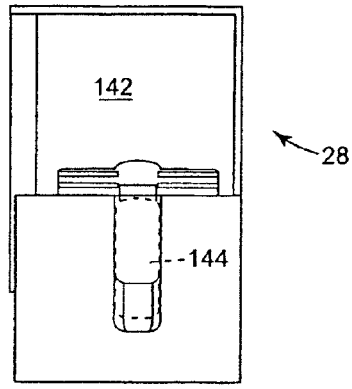
FIG. 13 depicts the card stop in a closed position.

Referring now to FIGS. 12 and 13, the front portion of the rack assembly 28 includes a solenoid or motor operated gate 144 and a door (card stop) 142 for controlling the unloading of the cards into the second card receiving platform 36. Although a separate, vertically movable gate 144 and card stop 142 are depicted, the function, stopping the forward movement of the cards, could be accomplished either by a lateral moving gate or card stop alone (not shown) or by other means. In FIG. 13, the gate 144 is shown in its raised position and FIG. 12 depicts it in its lowered open position. The position of the gate 144 and stop 142 is related by the microprocessor to the rack assembly 28 position.

Card Moving Mechanism

Figure 5:
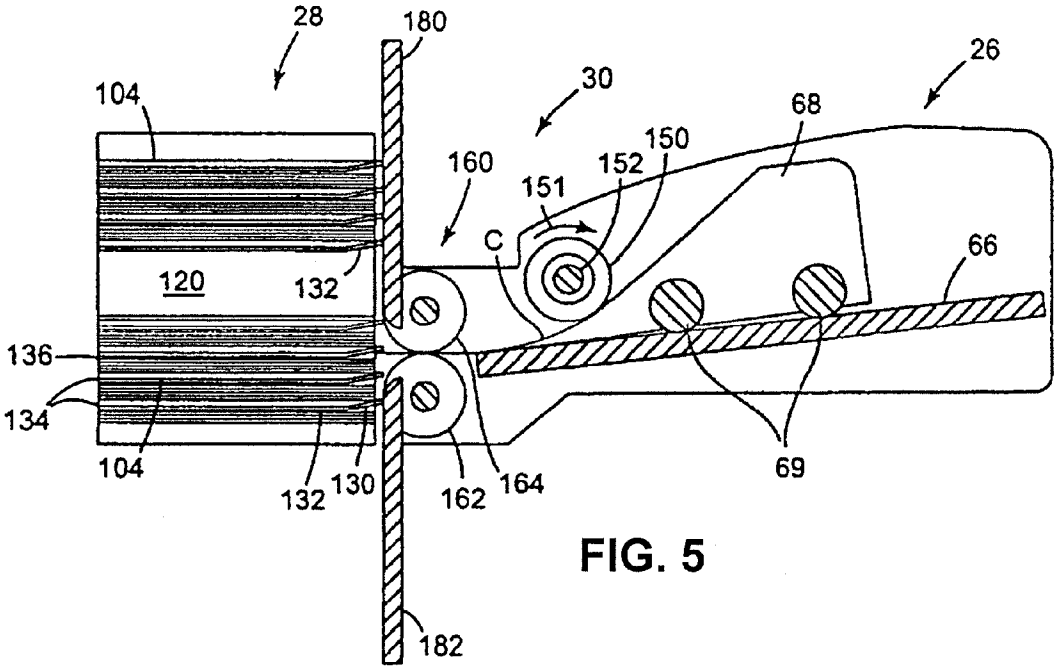
FIG. 5 is a side elevation view, largely representational, of the transport mechanism of the apparatus of the present invention.
Figure 5B:
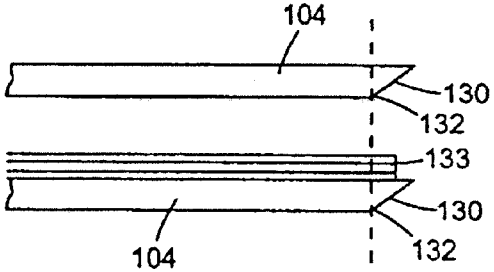
FIG. 5B is a cross-sectional view of a shelf with cards fully inserted.
Figure 5A:
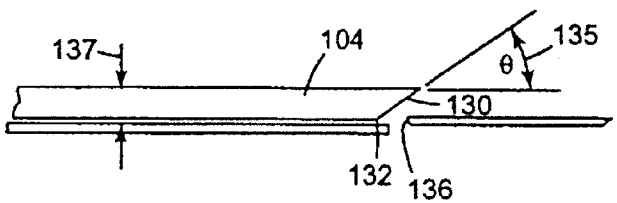
FIG. 5A is a detailed cross-sectional view of a shelf of one example of the invention.

Referring now to FIGS. 4, 5 and 6, a preferred card transporting or moving mechanism 30 is positioned between the card receiving well 60 and the compartments 106, 120 of the rack assembly 28 and includes a card pick-up roller assembly 149. The card pick-up roller assembly 149 includes a pick-up roller 150 and is located generally at the forward portion of the well 60. The pick-up roller 150 is supported by a bearing-mounted axle 152 extending generally transversely across the well 60 whereby the card contacting surface of the roller 150 is in close proximity to the forward portion of the floor surface 66. The roller 150 is driven by a pick-up motor 154 operably coupled to the axle 152 by a suitable continuous connector 156 such as a belt or chain. In operation, the front card in the well 60 is urged against the roller 150 by block 68 that when the roller 150 is activated, the frictional surface draws the front card downwardly and forwardly.

Referring now to FIGS. 4 and 5, the preferred card transporting mechanism 30 also includes a pinch roller card accelerator or speed-up system 160 located adjacent to the front of the well 60 between the well 60 and the rack assembly 28 and forwardly of the pick-up roller 150. The speed-up system 160 comprises a pair of axle-supported, closely adjacent speed-up rollers, one above the other, including a lower roller 162 and an upper idling roller 164. The upper idling roller 164 is urged toward the lower roller 162 by a spring assembly 166. Alternatively, it may be weighted or drawn toward the lower roller by a resilient member (not shown). The lower roller 162 is driven by a speed-up motor 167 operably linked to the driven lower roller 162 by a suitable connector 168 such as a belt or a chain. A mounting bracket 170 for the speed-up rollers 162, 164 also supports a rearward card-in sensor 174 and a forward card-out sensor 176. FIG. 5 is a largely representational view depicting the relationship between the card receiving well 60 and the card transporting mechanism 30, and also shows a card "C" being picked up by the pick-up roller 150 moving in rotational direction 151 and being moved into the pinch roller system 160 for acceleration into a compartment 106 of the rack assembly 28.

In a preferred embodiment, the pick-up roller 150 is not continuously driven, but rather indexes and includes a one-way clutch mechanism. After initially picking up a card C and advancing it into the pinch roller system 160, the motor 154 operably coupled to the pick-up roller 150 stops driving the roller 150, and the roller 150 free-wheels as the card C is accelerated through the pinch roller system 160. The speed-up pinch roller system 160 is preferably continuous in operation once a hand-forming cycle starts and, when a card is sensed by the adjacent card-out sensor 176, the pick-up roller 150 stops and free wheels while the card is accelerated through the pinch roller system 160. When the trailing edge of the card is sensed by the card-out sensor 176, the rack assembly 28 moves to the next position for the next card and the pick-up roller 150 is re-activated.

Additional components and details of the transporting mechanism 30 are depicted in FIG. 6, an exploded assembly view thereof. In FIG. 6 the inclined floor surface 66 of the well 60 is visible, as are the axle-mounted pick-up roller 150 and pinch roller system 160, respectively, and their relative positions.

Referring to FIGS. 4 and 5, the transporting mechansim 30 includes a pair of generally rigid stopping plates including an upper stop plate and a lower stop plate, 180, 182, respectively. The plates 180, 182 are positioned between the rack assembly 28 and the speed-up system 160 immediately forward of and above and below the pinch rollers 162, 164. The stop plates 180, 182 stop the cards from rebounding or bouncing rearwardly, back toward the pinch rollers 162, 164, as they are driven against and contact the gate 144 and/or the stop 142 at the front of the rack assembly 28.

Processing/Control Unit

Figure 16:
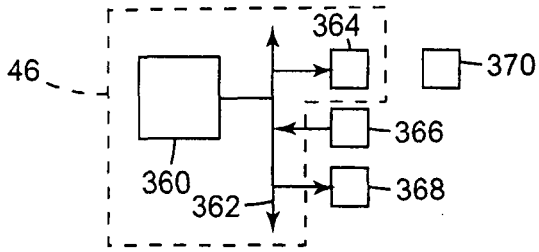
FIG. 16 is a schematic diagram of an electrical control system for one embodiment of the present invention.

FIG. 16 is a block diagram depicting an electrical control system 46, which may be used in one embodiment of the present invention. The control system 46 includes a controller 360, a bus 362, and a motor controller 364. Also represented in FIG. 16 are inputs 366, outputs 368, and a motor system 370. The controller 360 sends signals to both the motor controller 364 and the outputs 368 while monitoring the inputs 366. The motor controller 364 interprets signals received over the bus 362 from the controller 360. The motor system 370 is driven by the motor controller 364 in response to the commands from the controller 360. The controller 360 controls the state of the outputs 368 and the state of the motor controller 364 by sending appropriate signals over the bus 362.

In a preferred embodiment of the present invention, the motor system 370 comprises motors that are used for operating components of the card handling apparatus 20. Motors operate the pick-up roller, the pinch, speed-up rollers, the pusher and the elevator. The gate and stop may be operated by a motor, as well. In such an embodiment, the motor controller 364 would normally comprise one or two controllers and driver devices for each of the motors used. However, other configurations are possible.

The outputs 368 include, for example, alarm, start, and reset indicators and inputs and may also include signals that can be used to drive a display device (e.g., an LED display, not shown). Such a display device can be used to implement a timer, a card counter, or a cycle counter. Generally, an appropriate display device can be configured and used to display any information worthy of display.

The inputs 366 are information from the limit switches and sensors described above. The controller 360 receives the inputs 366 over the bus 362.

Figure 17:
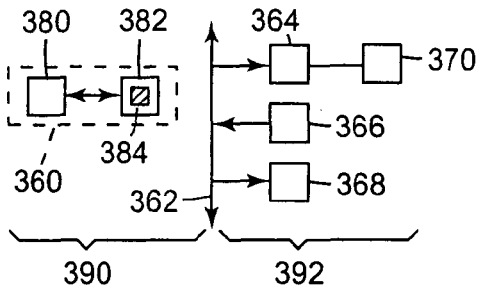
FIG. 17 is a schematic diagram of the electrical control system.

Although the controller 360 can be any digital controller or microprocessor-based system, in a preferred embodiment, the controller 360 comprises a processing unit 380 and a peripheral device 382 as shown in FIG. 17. The processing unit 380 in a preferred embodiment may be an 8-bit single-chip microcomputer such as an 80C52 manufactured by the Intel Corporation of Santa Clara, Calif. The peripheral device 382 may be a field programmable micro-controller peripheral device that includes programmable logic devices, EPROMs, and input/output ports. As shown in FIG. 17, peripheral device 382 serves as an interface between the processing unit 380 and the bus 362.

The series of instructions are stored in the controller 360 as shown in FIG. 17 as program logic 384. Preferred instructions include a random number generator executed in hardware, software or a combination thereof that randomly selects a) a hand to receive fewer or more cards than a pre-programmed or base number of cards and b) the number of extra or fewer cards to be dispensed. The instructions may include frequency of such random events, and when cards are dealt to a known number of positions at a table (e.g., known by either dealing to all positions in pai gow poker, or to a specific number of positions where players and dealer are known to be in a particular round of the game), the instructions may include random selection of positions for receiving hands. In a preferred embodiment, the program logic 384 is RAM or ROM hardware in the peripheral device 382. (Since the processing unit 380 may have some memory capacity, it is possible that some or all of the instructions may be stored in the processing unit 380.) As one skilled in the art will recognize, various implementations of the program logic 384 are possible. The program logic 384 could be either hardware, software, or a combination of both. Hardware implementations might involve hardwired code or instructions stored in a ROM or RAM device. Software implementations would involve instructions stored on a magnetic, optical, or other media that can be accessed by the processing unit 380. Under certain conditions, it is possible that a significant amount of electrostatic charge may build up in the card handling apparatus 20. Significant electrostatic discharge could affect the operation of the card handling apparatus 20. It is preferable to isolate some of the circuitry of the control system from the rest of the machine. In a preferred embodiment of the present invention, a number of optically coupled isolators are used to act as a barrier to electrostatic discharge.

Figure 18:
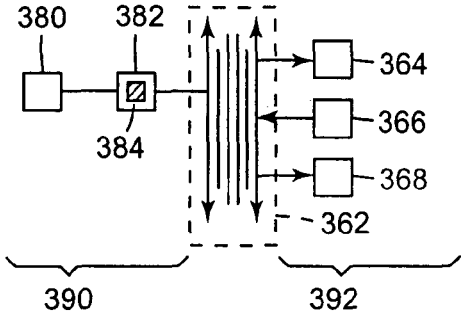
FIG. 18 is a schematic diagram of an electrical control system with an optically isolated bus.
Figure 19:
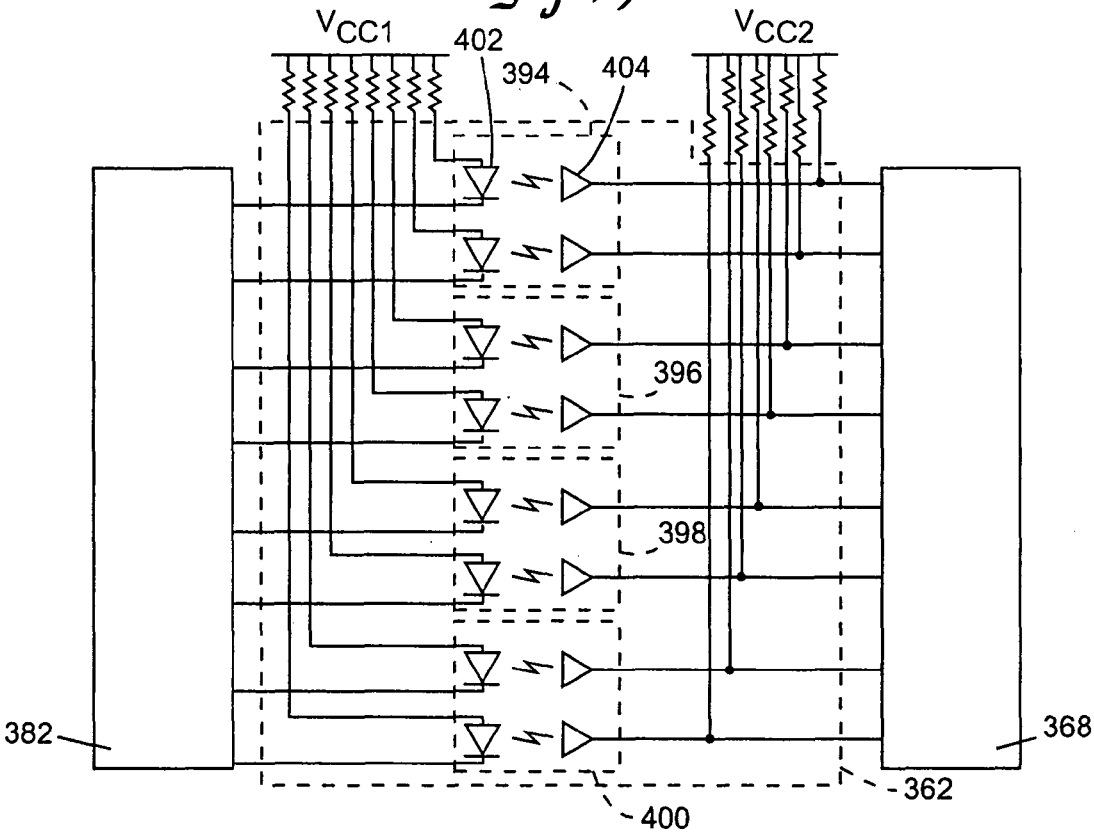
FIG. 19 is a detailed schematic diagram of a portion of the control system illustrated in FIG. 18.

As shown in FIG. 18, a first group of circuitry 390 can be electrically isolated from a second group of circuitry 392 by using optically coupled logic gates that have light-emitting diodes to optically (rather than electrically) transmit a digital signal, and photo detectors to receive the optically transmitted data. An illustration of electrical isolation through the use of optically coupled logic gates is shown in FIG. 19, which shows a portion of FIG. 18 in greater detail. Four Hewlett-Packard HCPL-2630 optocouplers (labeled 394, 396, 398 and 400) are used to provide an 8-bit isolated data path to the output devices 368. Each bit of data is represented by both an LED 402 and a photo detector 404. The LEDs 402 emit light when energized and the photo detectors 404 detect the presence or absence of the light. Data may thus transmit without an electrical connection.

Second Card Moving Mechanism

Referring to FIGS. 4 and 8, the apparatus 20 includes a second card moving mechanism 34 comprising a reciprocating card compartment-unloading pusher 190. The pusher 190 includes a substantially rigid pusher arm 192 in the form of a rack having a plurality of linearly arranged apertures 194 along its length. The arm 192 operably engages the teeth of a pinion gear 196 driven by an unloading motor 198, which is in turn controlled by the controller 360. At its leading or card contacting end, the pusher arm 192 includes a blunt, enlarged card contacting end portion 199. The end portion 199 is greater in height than the space between the shelf members 104 forming the compartments 106 to make sure that all the cards (i.e., the hand) contained in a selected compartment 106 are contacted and pushed out as it is operated, even when the cards are bowed or warped. The second card moving mechanism 34 is operated intermittently (upon demand or automatically) to empty full compartments 106 at or near the end of a cycle.

Second Card/Hand Receiver

When actuated, the second card moving mechanism 34 or pusher 190 empties a compartment 106, 120 by pushing the group of cards therein into a card receiving platform 36. The card receiving platform 36 is shown in FIGS. 1, 4, 14 and 15, among others.

Figure 15:
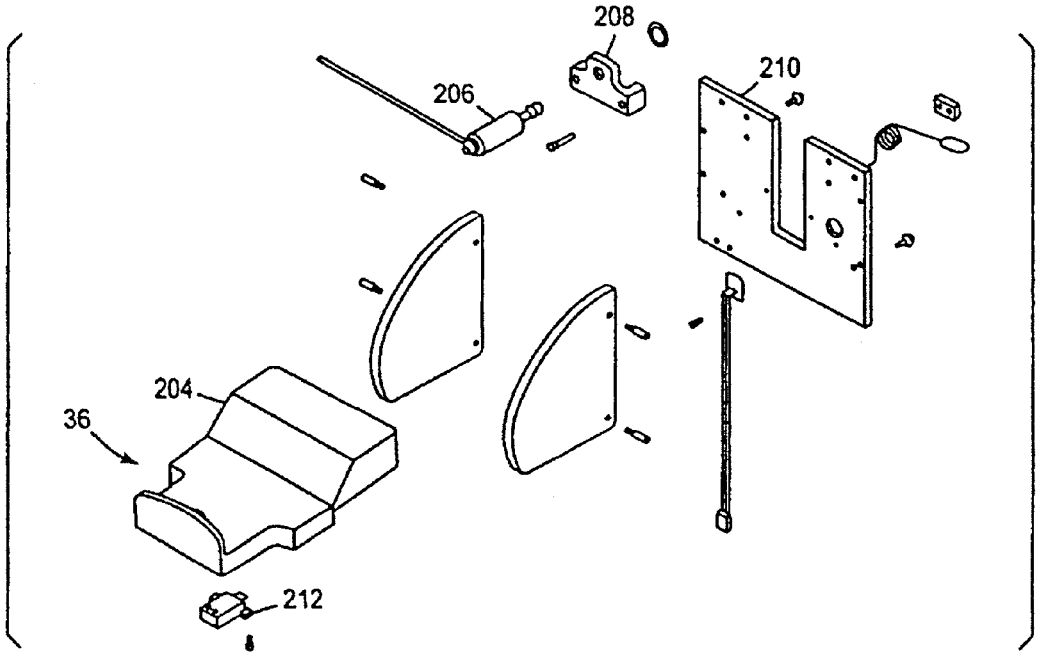
FIG. 15 is an exploded view of the hand receiving assembly of the apparatus of the present invention.

Referring to FIG. 15, the second card or hand receiving platform 36 includes a shoe plate 204 and a solenoid assembly 206, including a solenoid plate 208, carried by a rear plate 210, which is also the front plate of the rack assembly 28. In an alternate embodiment, a motor drives the gate. The shoe plate 204 also carries an optical sensing switch 212 for sensing the presence or absence of a hand of cards and for triggering the microprocessor to drop the gate 144 and actuate the pusher 190 of the second card-moving mechansim 34 to unload another hand of cards from a compartment 106, 120 when the hand receiving platform 36 is empty. In a first preferred embodiment, the player hands are unloaded sequentially. After the dealer receives his hand (typically the dealer hand is delivered last, except in one of the seven possible distributions in pai gow poker), he or she presses a button, which instructs any remaining hands and the discard pile to unload. According to a second preferred embodiment, the microprocessor is programmed to randomly select and unload all player hands, then the dealer hand, and last the discard pile. The shuffler may also be equipped to receive signals from other devices, such as bet sensors, so that only a number of hands in play is dispensed, and then all remaining cards are automatically unloaded.

Figure 14:
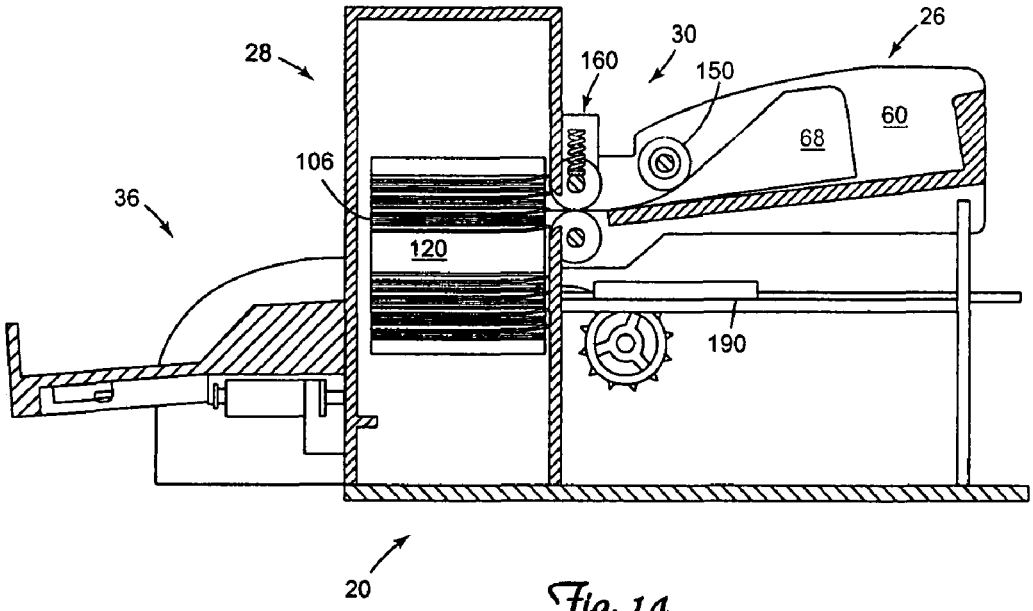
FIG. 14 is a simplified side elevational view, largely representational, of the first card handler of the present invention.

FIG. 14 is a largely representational view depicting the apparatus 20 and the relationship of its components including the card receiver 26 for receiving a group of cards for being formed into hands, including the well 60 and block 68, the rack assembly 28 and its single stack of card receiving compartments 106, 120, the card moving or transporting mechanism 30 between and linking the card receiver 26 and the rack assembly 28, the pusher 190 for emptying the compartments 106, 120, and the second card receiving platform 36 for receiving hands of cards.

Alternative Embodiments

Figure 20:
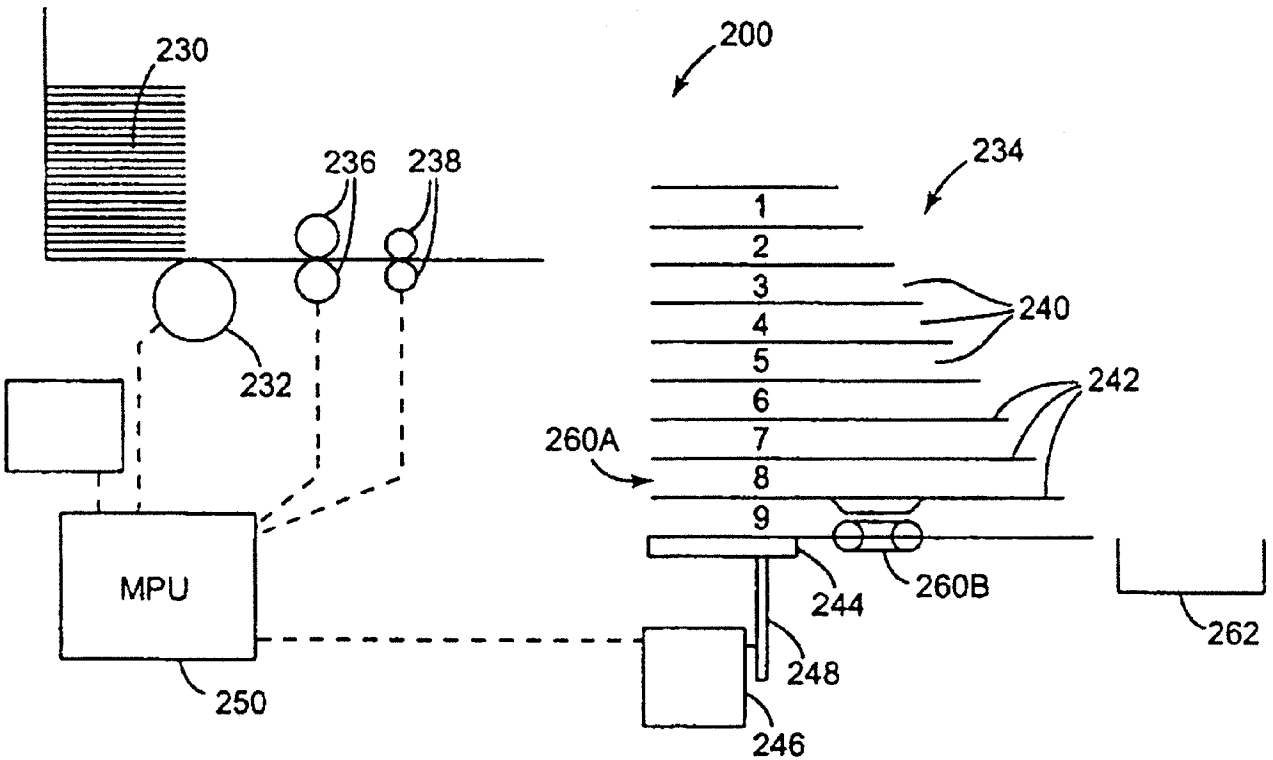
FIG. 20 schematically depicts an alternative embodiment of the apparatus of the present invention.

FIG. 20 represents an alternative embodiment of the presently described technology wherein a card handler 200 includes an initial staging area 230 for receiving a vertically stacked deck or group of unshuffled cards. Preferably beneath the stack is a card extractor 232, which picks up a single card and moves it toward a grouping device 234. The picked up card moves through a card separator 236, which is provided in case more than one card is picked up, and then through a card accelerator 238. The grouping device 234 includes a plurality of compartments 240 defined, in part, by a plurality of generally horizontally disposed, parallel shelf members 242. In one embodiment there are two more compartments than player positions at the table at which the device is being used. In one preferred embodiment the grouping device 234 includes nine compartments 240 (labeled 1-9), seven of which correspond to the player positions, one of which corresponds to the dealer's position, and the last of which is for discards. The grouping device 234 is supported by a generally vertically movable elevator 244, the height of which is controlled by a stepper motor 246, linked by means of a belt drive 248 to the elevator 244. A microprocessor 250 randomly selects the location of the stepper motor 246 and instructs the stepper motor 246 to move the elevator 244 to that position. The microprocessor 250 is programmed to deliver a predetermined number of cards to each compartment 240. After the predetermined or randomly determined number of cards is delivered to a compartment 240, no additional cards will be delivered to that compartment 240.

Each time a group of unshuffled cards is handled by this embodiment of the presently described technology, the order in which the cards are delivered to the compartments 240 is different due to the use of a random number generator to determine which compartment 240 receives each card in the group. Making hands of cards in this particular fashion serves to randomize the cards to an extent sufficient to eliminate the need to shuffle the entire deck prior to forming hands. A feature of the embodiment of the present invention depicted in FIG. 20 is a card pusher or rake 260A. The rake 260A may be either an arm with a head which pushes horizontally from the trailing edge of a card or group of cards, or a roller and belt arrangement 260B that propels a card or group of cards by providing frictional contact between one or more rollers and a lower surface of a card or the bottom-most card. The purpose of the rake 260A is to move the cards toward an open end of the elevator 244. In this embodiment of the invention, the compartments 240 are staggered so that if the card rake 260A only pushes the dealt cards a portion of the way out the dealer can still lift out each hand of cards and deliver the hand to a player. The rake 260A can also be set to push a hand of cards completely out of a compartment 240 whereby the cards fall onto a platform 262. The hand delivered to platform 262 may be then removed and handed to the player. A sensor (not shown) may be provided adjacent to the platform 262 whereby an empty platform is sensed so that the rake 260A pushes or propels another hand of cards onto the platform 262. This same random number generator or a separate random number generator may be used in the practice of the presently described technology to randomly select how many cards will go into a hand, which hand(s) will receive a random number of cards, how frequently a random number of cards will be provided, which player will receive the random number of cards, whether a player or a dealer will receive a hand with a random number of cards, and the like.

In another embodiment the microprocessor 250 is programmed so that the card rake 260A moves the cards to a point accessible to the dealer and then, upon optional activation of a dealer control input, pushes the cards out of the compartment 240 onto the platform 262.

In a preferred embodiment of the device depicted in FIG. 20, although the microprocessor 250 can be programmed to deliver a different number of cards to the dealer compartment than to the player compartments, it is contemplated that the microprocessor 250 will cause the card handler 200 to deliver the same number of cards to each compartment 240. The dealer, however, may discard cards until he or she arrives at the desired number of dealer cards for the particular game being played. For example, for the poker game known as the LET IT RIDE® game, the players and dealer initially receive a three-card hand. The dealer then discards or burns one of his cards and plays with the remaining two cards.

With continued reference to FIG. 20, nine card compartments or slots are depicted. The card extractor/separator combination delivers a selected number of player cards into each of the compartments labeled 1-7. Preferably, the same number of dealer's cards may be delivered into compartment 8. Alternatively, the microprocessor 250 can be programmed so that compartment 8 will receive more, fewer, or the same number of cards as the players' compartments 1-7. In the embodiment depicted in FIG. 20, card receiving compartment 9, which may be larger than the others, receives all extra cards from a deck. Preferably, the MPU instructs the card handler 200 to form only the maximum number of player hands plus a dealer hand. The number of cards delivered to each position may depend upon the game and the number of cards required.

Operation/Use

With reference to FIGS. 21A, 21B and 22A-22C, and Appendix C, which depict an operational program flow of the method and apparatus of the present invention, in use, cards are loaded into the well 60 by sliding or moving the block 68 generally rearwardly. The group of cards to be formed into hands is placed into the well 60 generally sideways, with the plane of the cards generally vertical, on one of the long side edges of the cards. The block 68 is released or replaced to urge the cards into an angular position generally corresponding to the angle of the angled card contacting face of the block 68, and into contact with the pick-up roller 150.

According to the presently described technology, the group of cards to be formed into hands is a single deck of standard playing cards. Depending upon the game, the group of cards can contain one or more wild cards, can be a standard deck with one or more cards removed, can comprise a special deck, such as a canasta or SPANISH 21® deck, for example, can include more than one deck, or can be a partial deck not previously recognized by those skilled in the art as a special deck. The present invention contemplates utilizing any group of cards suitable for playing a card game. For example, one use of the device of the present invention is to form hands for a card game, which requires the use of a standard deck of cards with all cards having a face value of 2-5 removed. The card handling device of the present invention may also be used for card games that deliver a fixed number of cards to each player. For example, the LET IT RIDE® stud poker game requires that the dealer deliver three cards to each player, and three cards to the dealer. For this application, the microprocessor is set so that only three card-hands are formed.

Figure 21A:
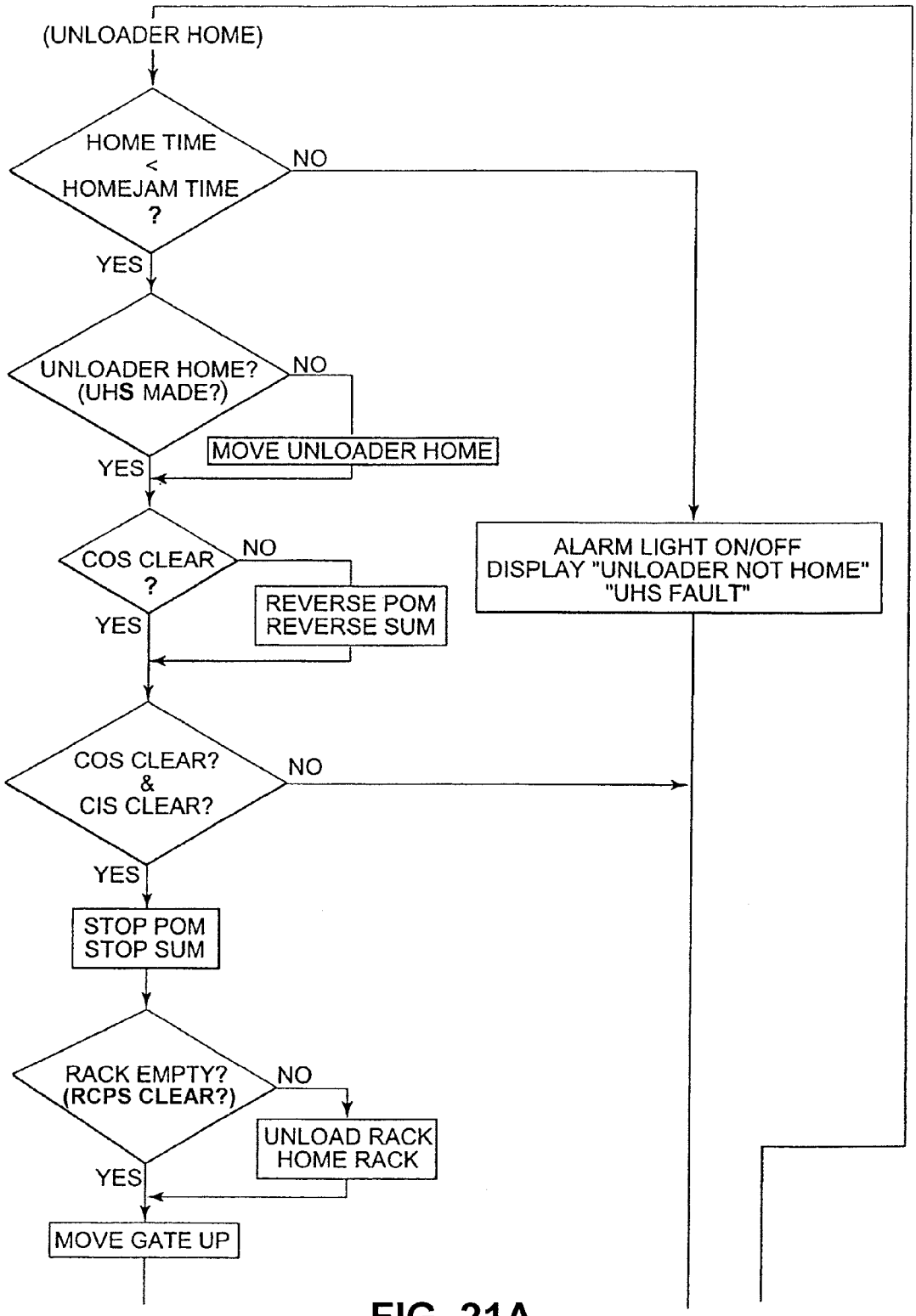
FIGS. 21A and 21B are flow diagrams depicting a homing sequence.
Figure 21B:
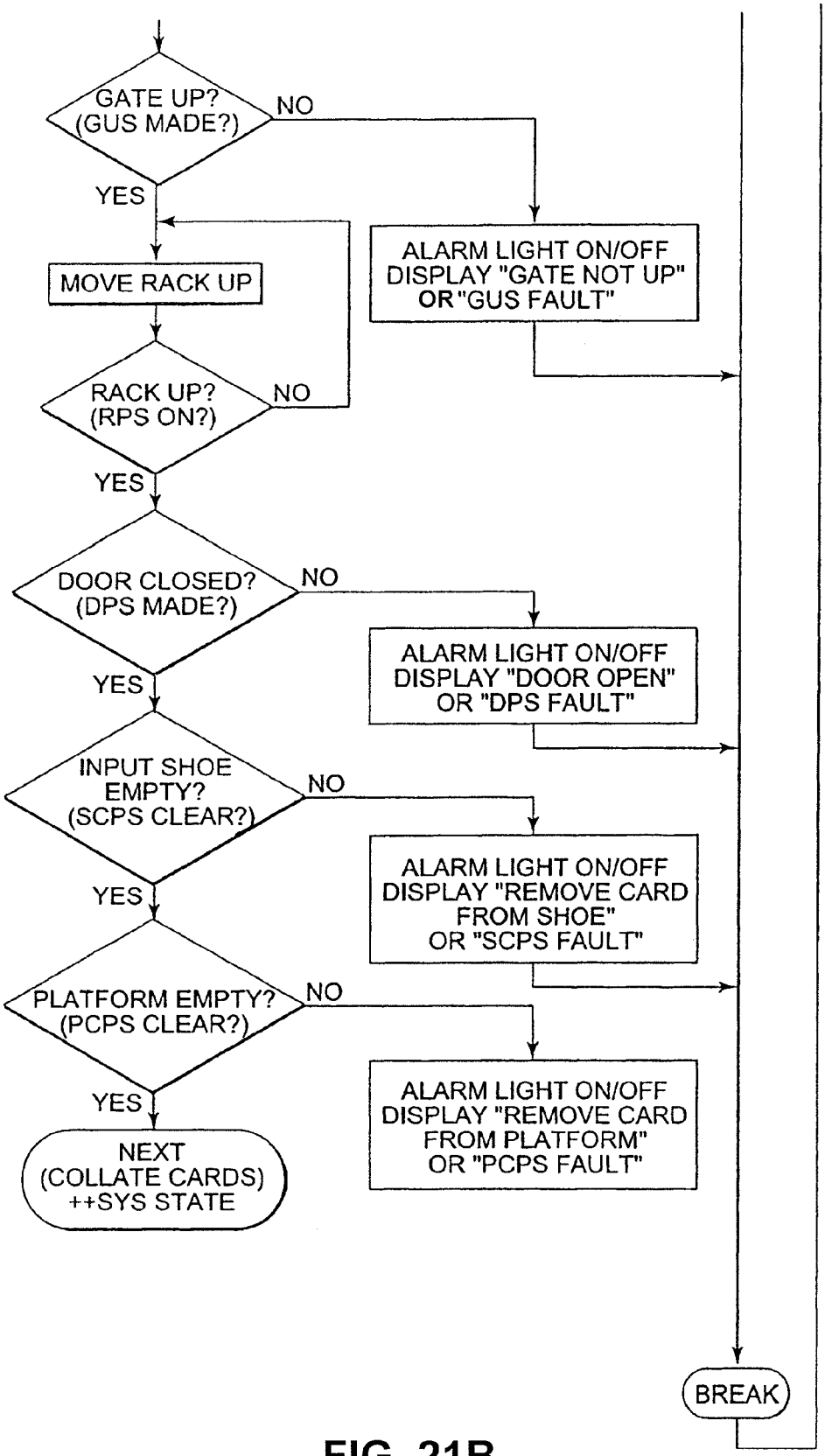
Figure 22A:
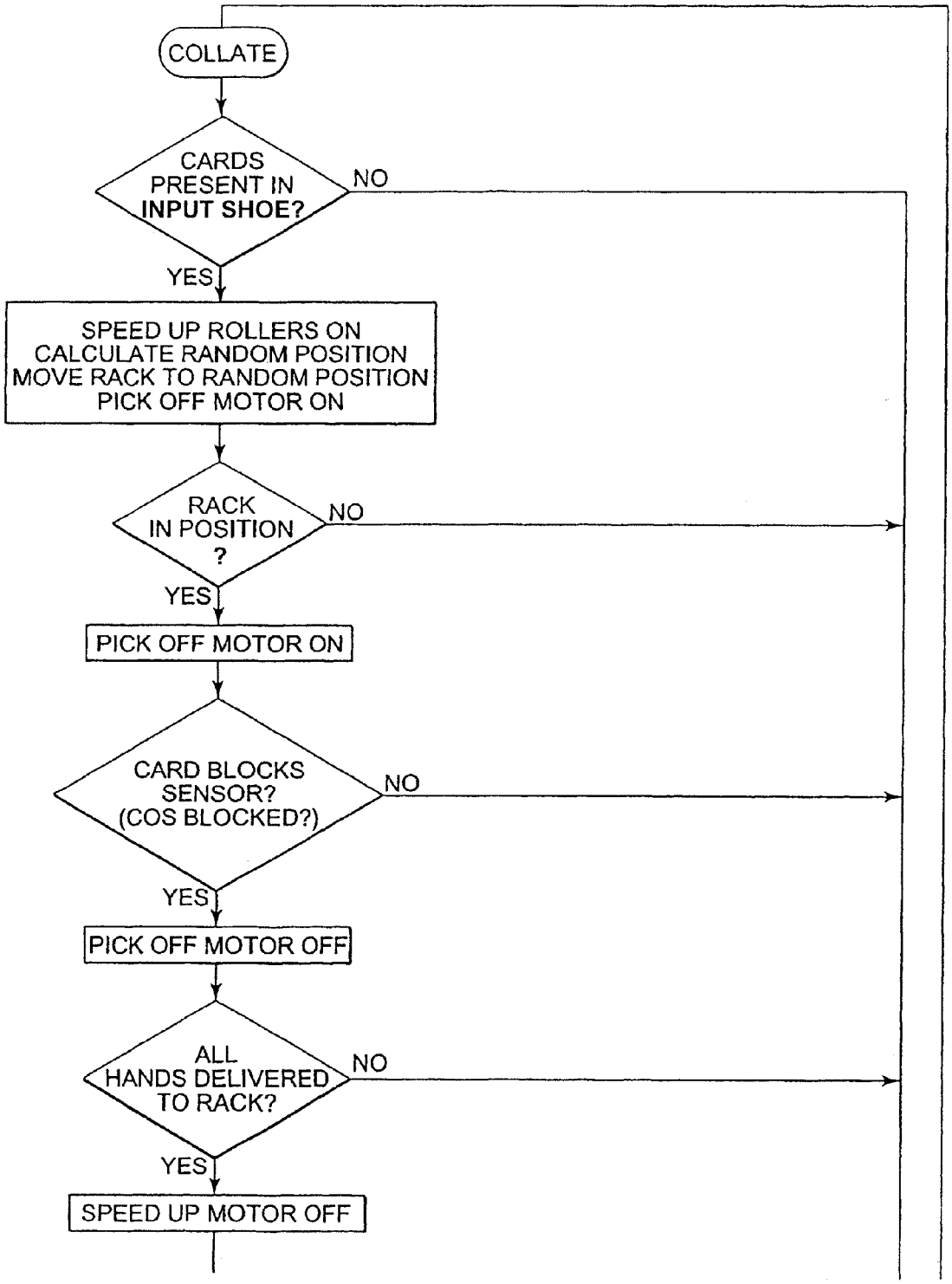
Figure 22C:
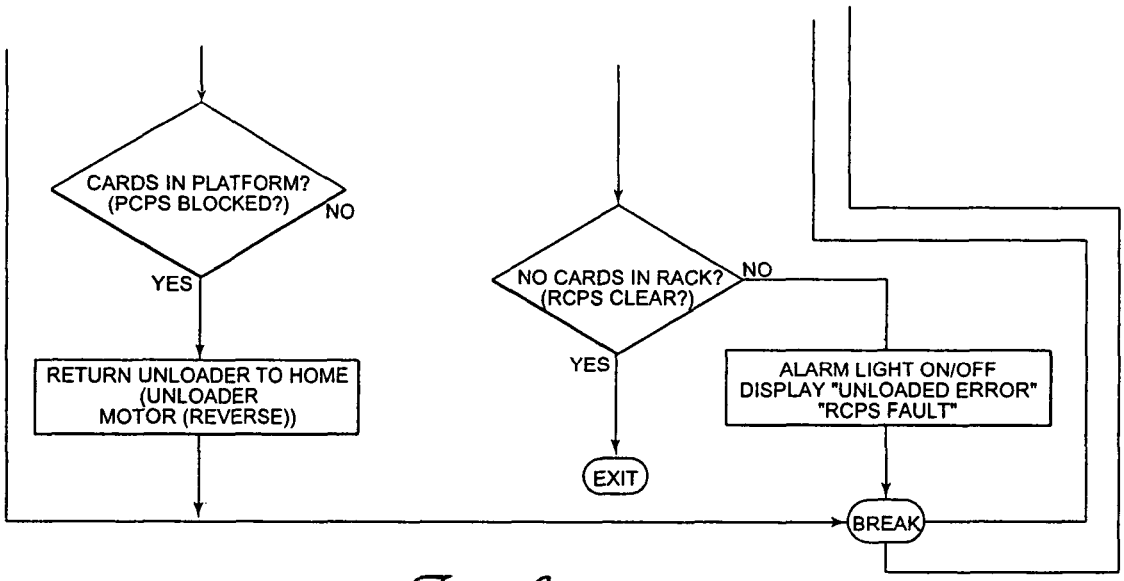

When the power is turned on, the apparatus 20 homes (see FIGS. 21A and 21B and Appendix B). The start input is actuated and the process cycle begins. As the cards are picked up, i.e., after the separation of a card from the remainder of the group of cards in the well 60 is started, a card is accelerated by the speed-up system 160 and spit or moved past the plates 180, 182 into a selected compartment 106, 120. Substantially simultaneously, movement of subsequent cards is underway. The rack assembly 28 position relative to the position of the transporting mechanism 30 is monitored, selected and timed by the microprocessor whereby a selected number of cards is delivered randomly to selected compartments 106 until the selected number of compartments 106 each contain a randomized hand of a selected number of cards. The remainder of the cards is delivered to the discard compartment 120. Because the order in which the cards are delivered is completely random, the apparatus 20 may or may not deliver all cards in the initial group of cards to all compartments 106 before the first player hand is pushed out of its compartment 106.

When all the cards have been delivered to the compartments 106, upon demand or automatically, the pusher 190 unloads one randomly selected hand at a time from a compartment 106 into the second card receiving platform 36. The pusher 190 may be triggered by the dealer or by the optical sensing switch 212 associated with the second card receiving platform 36. When the last hand is picked up and delivered to players and/or dealer, the larger discard compartment 120 automatically unloads. It should be appreciated that each cycle or operational sequence of the card handling apparatus 20 goes through an entire group or deck of cards placed in the well 60 each time, even if only two players, i.e., two hands, are used.

Figure 23:
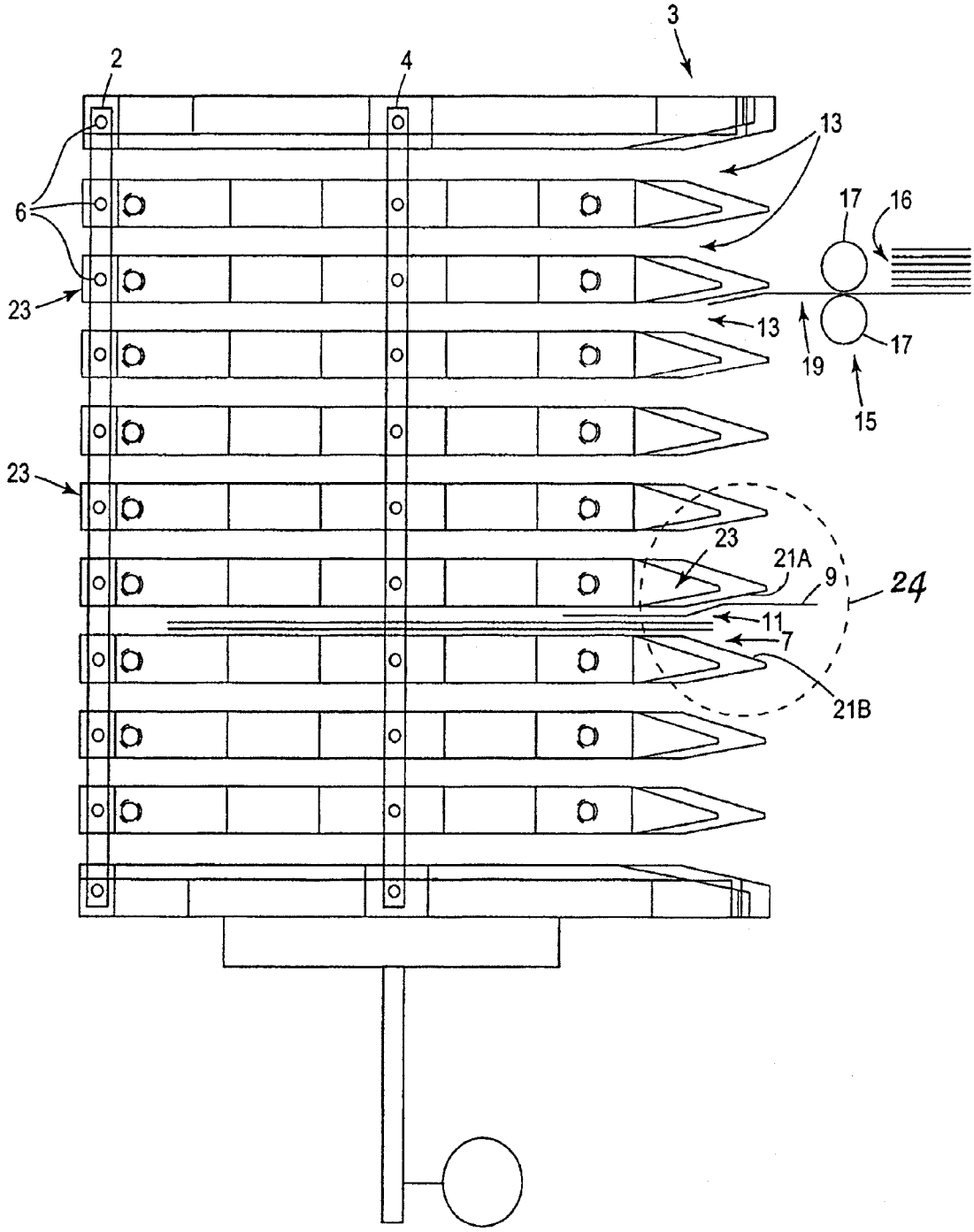
FIG. 23 shows a side cutaway view of a rack comprising a series of compartments with separators having two acute surfaces on an edge of the separators facing a source of cards to be inserted into the compartments.

FIG. 23 also shows a clearly optional method of controlling the entry of cards into a rack 3 of card receiving compartments 13. A card delivery system 15 is shown wherein two nip rollers 17 accept individual cards 19 from a stack of cards 16 and direct the individual cards 19 into a single card receiving compartment 13. As shown in a lower portion of FIG. 23, a single card 9 is directed into one of the card receiving compartments 13 so that the individual card 9 strikes one of the acute angle surfaces 21A, 21B, respectively, of a separator 23. The single card 9 is shown with a double bend 11 caused by the forces from the single card 9 striking the acute angle surface 21A, 21B and then the top of cards 7 already positioned within the card receiving compartment 13. The card delivery system 15 and/or the rack 3 may move vertically (and/or angularly, as explained later) to position individual cards (e.g., 9) at a desired elevation and/or angle in front of individual card receiving compartments 13. The specific distance or angle that the card delivery system 15 and/or rack 3 moves are controlled (when acute angle surfaces 21A, 21B of the separators 23 are available) to position the individual card 9 so that it deflects against a specific acute angle surface 21A, 21B.

An alternative method of assisting in the guidance of an individual card 9 against an acute angle surface 21A, 21B is the system shown that is enabled by bars 2 and 4. The bars 2 and 4 operate so that as they move relative to each other, the separators 23 may swivel around pins 6 causing the separators 23 to shift, changing the effective angle of the deflecting acute angle surfaces 21A, 21B with respect to individual cards 9. This is not as preferred as the mechanism by which the rack 3 and/or the card delivery system 15 move relatively vertically to each other.

Figure 24:
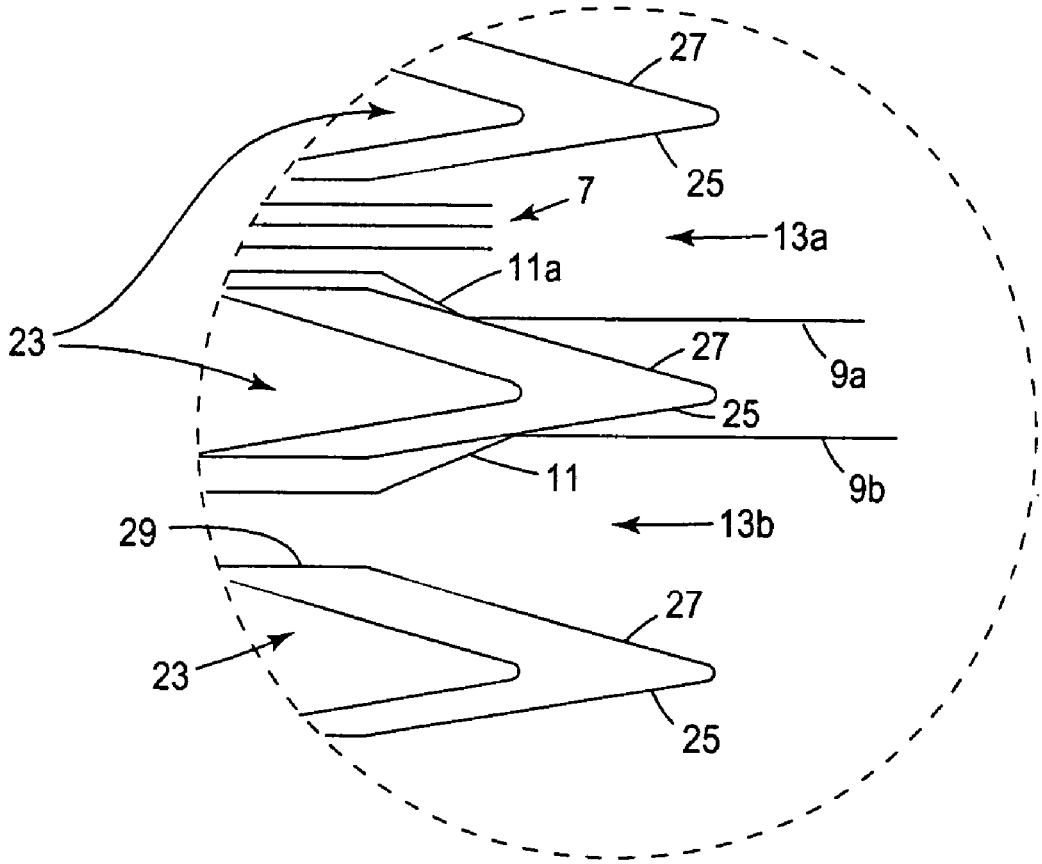
FIG. 24 shows an enlarged image of three adjacent acute surface edges of separators in the rack of separators.

FIG. 24 shows a blown-up view of a set of three separators 23. These separators 23 are shown with acute angles (less than 90° with respect to horizontal or the plane of the separator 23 top surfaces 29) on both sides of the separators 23. An upward deflecting surface 27 and downward deflecting surface 25 are shown on each separator 23. In one section of FIG. 24, a single card 9*a* is shown impacting the upward deflecting surface 27, deflecting (and bending) individual card 9*a* in a two-way bend 11*a*, the second section of the bend 11*a* caused by the impact/weight of the cards 7 already within the compartment 13*a*. In a separate area of FIG. 24, a second individual card 9*b* is shown in compartment 13*b*, striking downward deflecting surface 25, with a double bend 11 caused by deflection off the surface 25 and then deflection off the approximately horizontal support surface 29 (or if cards are present, the upper surface of the top card) of the separator 23. The surface 29 does not have to be horizontal, but is shown in this manner for convenience. The card delivery system (not shown) moves relative to the separators 23 (by moving the card delivery system and/or the rack (not shown in entirety) to position individual cards (e.g., 9*a* and 9*b*) with respect to the appropriate surfaces (e.g., 25 and 27)).

The capability of addressing cards into compartments at either the top or bottom of the compartment (and consequently at the top or bottom of other cards within the compartment) enables an effective doubling of potential positions where each card may be inserted into compartments. This offers the designer of the device options on providing available alternative insert positions without adding additional card receiving compartments. More options available for placement of cards in the compartments further provides randomness to the system without increasing the overall size of the device or increasing the number of compartments.

In this embodiment of the described technology, the original rack has been replaced with rack 3 consisting of ten equally sized compartments. Cards are delivered in a random fashion to each rack. If the random number generator selects a compartment that is full, another rack is randomly selected.

In this embodiment, each stack of cards is randomly removed and stacked in platform 36, forming a randomly arranged deck of cards. Although ten compartments is a preferred number of compartments for shuffling a fifty-two card deck, other numbers of compartments can be used to accomplish random or near-random shuffling. If more than one deck is shuffled at a time, more compartments could be added, if needed.

Although a description of preferred embodiments has been presented, various changes including those mentioned above could be made without deviating from the spirit of the presently described technology. It is desired, therefore, that reference be made to the appended claims rather than to the foregoing description to indicate the scope of the invention.

It is clear from the above-described examples and embodiments that a number of different shuffling mechanisms can be used to randomize the cards, either before or during hand randomization. For example, RANDOM EJECTION SHUFFLER™ devices (e.g., as disclosed in U.S. Pat. Nos. 6,722,974; 6,651,985; 6,299,167; 6,270,404; 6,165,069; 6,019,368; 5,676,372; and 5,584,483) could be used to randomize either all or part of the group of cards (e.g., one or more decks) to be shuffled, and then a hand of randomly determined numbers of cards could be formed by removing cards individually or as a group from the randomized all or part of the group, or by feeding random numbers of cards to a delivery tray. Other examples of useful formats of shufflers have been described above, including but not limited to U.S. Pat. No. 5,275,411 (Breeding), U.S. Pat. Nos. 6,655,684; 6,651,982; 6,651,981; 6,588,751; 6,588,750; 6,568,678; 6,325,373; 6,254,096; 6,149,154; 6,139,014; 6,068,258; and 5,695,189 (Breeding et al.); U.S. Pat. No. 6,659,460 and U.S. Patent Application Publication 2003/0071413A1 (Blaha et al.); and U.S. Pat. Nos. 5,683,085 and 6,267,248 (Johnson et al.). These embodiments include speeding up shuffling time and hand delivery time by having hands either simultaneously formed and shuffled or formed from a smaller sub-set of randomized/shuffled cards. These techniques eliminate or reduce the waiting for a complete group of cards to be randomized before hands are formed.

The device that either a) forms hands or b) forms hands and randomizes cards has a processor with one or more random number generators that can determine any of the following functions: a) the number of cards per hand; b) the frequency of occurrence of extra or fewer cards in a hand; c) the number of extra or fewer cards in a hand; d) a location to which to deliver each card; etc. The random number generator (RNG) may be programmed or hard-wired to operate within certain parameters, such as random frequency but no more often than every 100 hands; random numbers of cards, but no more than X cards and no fewer than Y cards, etc.

Specific devices within the generic scope of the disclosed technology can advantageously be used to provide new and exciting features to a card game based on the chance or random occurrence of fewer or extra cards to a player, dealer, community cards or combinations of the three.

Prior to the use of a random number generator to determine the number of cards in a hand, it was not even possible to offer such games, except if one had used an external device such as a prize wheel (also known as a candy wheel) to determine the random events such as player/dealer/community card positions and the number of cards to be received. Applicants are not aware of even that existence in commercial practice. Using such a device would provide security risks and potential for abuse or fraud. For example, particularly good card(s) could be passed by the dealer, the spin of the wheel could be manipulated, and the like.

Although it is desirable to include the random number generating functionality within the shuffler, it is also possible to provide such a function in an external computer or in a separate intelligent component (such as a G-Mod) in network or other form of communication with the shuffler. G-Mods and other formats of architecture are described in copending U.S. patent application Ser. Nos. 10/880,408 and 10/880,410, both filed on Jun. 28, 2004, which are incorporated herein by reference. For example, a gaming table might contain an automatic shuffler, hand forming device (integrated with or separate from the shuffler), a random number generator (RNG), and/or a plurality of bet sensors, each communicatively connected to an external micro-processor or field programmable gate array with network or system or individual component communication capability. The RNG could select a random number and transmit that number over a line or network to the shuffler to tell the shuffler when to dispense more or fewer cards and how many more or fewer cards to dispense.

The RNG function could also reside in a table game computer, pit computer or any other on-line or networked computer and be capable of sending instructions to the shuffler and/or hand-forming device.

APPENDIX A

Switches and Sensors (Inputs)

| Item | Name | Description | |
|---|---|---|---|
| 212 | SCPS | Shoe Card Present Sensor | Omron * EE-SPY 302 |
| 116 | RCPS | Rack Card Present Sensor | Optek * OP598A OP506A |
| | RHS | Rack Home Switch | Microswitch * SS14A |
| | RPS | Rack Position Sensor | Omron * EE-SPZ401Y.01 |
| | UHS | Unloader Home Switch | Microswitch * SS14A |
| | DPS | Door Present Switch | Microswitch * SS14A |
| | PCPS | Platform Card Present Sensor | Omron * EE-SPY401 |
| 170 | CIS | Card-In Sensor | Optek * OP506A |
| 176 | COS | Card-Out Sensor | Optek * OP598A |
| | GUS | Gate Up Switch | Microswitch * SS14A |
| 44 | GDS | Gate Up Switch | Microswitch SS14-A |
| | SS | Start Switch | EAO * 84-8512.5640 84-1101.0 84-7111.500 |
| 154 | POM | Pick-off Motor | Superior * M041-47103 |
| 166 | SUM | Speed-up Motor | Superior * M041-47103 |
| 80 | RM | Rack Motor | Oriental * C7009-9012K |
| 198 | UM | Unloader Motor | Superior * M041-47103 |
| | FM | Fan Motor | Mechatronics * F6025L24B |
| 143 | GS | Gate Solenoid | Shindengen * F10308H w/return spring |
| | GM | Gate Motor | NMB 14PM-MZ-02 |
| | SSV | Scroll Switch-Vertical | EAO * 18-187.035 18-982.8 18-920.1 |
| | SSH | Scroll Switch-Horizontal | EAO * 18-187.035 18-982.8 18-920.1 |
| | AL | Alarm Light | Dialight * 557-1505-203 |

| | |
|---|---|
| Display | Noritake * CU20025ECPB - UIJ |
| Power Supply | Shindengen * ZB241R8 |
| Linear Guide | THK * RSR12ZMUU + 145M |
| Comm. Port | Digi * HR021 - ND |
| Power Switch | Digi * SW 323 - ND |
| Power Entry | Bergquist * LT - 101 - 3P |

APPENDIX B

Homing/Power-up i. Unloader Home — UHS Made
Return unloader to home position. If it times out (jams), turn the alarm light on/off.
Display "UNLOADER NOT HOME" "UHS FAULT".

ii. Door Present — DPS Made
Check door present switch (DPS). If it's not made, display "Door Open" "DPS Fault" and turn the alarm light on/off.

iii. Card-Out Sensor (COS) Clear — COS Made
If Card-Out sensor is blocked:
A. Check if Rack Card Present Sensor (RCPS) is blocked. If it is, drive card back (reverse both Pick-off Motor (POM) and Speed-up Motor (SUM)) until COS is clear. Keep the card in the pinch. Align rack and load card into one of the shelves. Then go through the rack empty sequence (3 below).
B. If Rack Card Present Sensor (RCPS) is clear, drive card back towards the input shoe. Turn both the Speed Up Motor (SUM) and the Pick Off Motor on (reverse) until Card-Out Sensor is clear plus time delay to drive the card out of the pinch.

iv. Gate Up — GUS Made
Move reck up until the rack position sensor sees the top rack (RPS on). Gate up switch should be made (GUS). If not, display "GATE NOT UP" "GUS FAULT" and turn the alarm light on/off.

APPENDIX B-continued

| | | |
|---|---|---|
| v. | Rack Empty and Home<br>Check Rack Card Present Sensor (RCPS).<br>If blocked, see emptying the racks. Return back home when done.<br>INTERLOCK: Do not move rack if Card-Out sensor is blocked (see 2 to clear) or when door is not present.<br>Emptying the racks: Go through the card unload sequence. Move rack down to home position. Energize solenoid. Move rack through the unload positions and unload all the cards. | RCPS Made<br>RHS Made |
| vi. | Input Shoe Empty<br>If Shoe/Card Present Sensor (SCPS) is blocked, display "remove card from shoe" or "SCPS fault" and turn the alarm light on/off. | SCPS Clear |
| vii. | Platform Empty<br>If Platform Card Present Sensor (PCPS) is blocked, display "remove card from platform" or "PCPS Fault" and turn alarm light on/off. | PCPS Clear |
| viii. | Card-In Sensor (CIS) Clear.<br>If Card-In Sensor (CIS) is blocked, display "remove card from shoe" or "CIS fault" and turn the alarm light on/off. | CIS Made |

Start Position

| | |
|---|---|
| Unloader Home | UHS Made |
| Rack Home | RHS Made |
| Rack Empty | RCPS Made |
| Door In Place | DPS Made |
| Card-In Sensor Clear | CIS Made |
| Card-Out Sensor Clear | COS Made |
| Gate Up | GUS Made |
| Platform Empty | PCPS Clear |
| Input Shoe Empty | SCPS Clear |
| Start Button Light On | |

APPENDIX C

Recovery Routine

| | |
|---|---|
| Problem: | Card Jam-COS blocked too long. |
| Recovery: | 1. Stop rack movement.<br>2. Reverse both pick-off and speed-up motors until "COS" is unblocked. Stop motors.<br>3. If "COS" is unblocked, move rack home and back to the rack where the cards should be inserted.<br>4. Try again with a lower insertion point (higher rack) and slower insertion speed. If card goes in, continue insertion. If card jams, repeat with the preset positions, auto adjust to the new position. If jams become too frequent, display "check cards", replace cards. If it doesn't,<br>repeat 1 and 2.<br>5. If "COS" is unblocked, move rack up to the top position and display "Card Jam" and turn alarm light on/off.<br>6. If "COS" is not unblocked after 2 or 4, display "card jam" and turn . . . (do not move rack to up position). |
| Problem: | Unloader jams on the way out. |
| Recovery: | Move unloader back home. Reposition rack with a small offset up or down and try again, lower speed if necessary. If unloader jams, keep repeating at the preset location, set a new value based on the offset which works (auto adjust). |

What is claimed is:

1. An apparatus for providing hands of playing cards in a casino table card game comprising:

a playing card input holder;

a container for receiving playing cards from the card input holder;

a delivery tray for receiving playing cards from the container;

a playing card moving system for moving a number of playing cards defining a hand of playing cards from the container to the delivery tray;

an operator input interface; and a processor containing software to direct the card moving system to randomly select how many playing cards will form the hand in the delivery tray.

2. The apparatus of claim 1, wherein the playing card moving system is configured to move the playing cards individually to the delivery tray.

3. The apparatus of claim 1, wherein the playing card moving system is configured to move the playing cards as a group to the delivery tray.

4. An apparatus for providing hands of playing cards in a casino table card game comprising:

a container for receiving a first group of playing cards;

a playing card shuffling and delivery system capable of forming random subsets of playing cards within the apparatus;

a playing card mover for moving the random subsets of playing cards to a delivery tray to form hands of playing cards; and a processor controlling the card mover;

wherein the processor contains at least one program that is capable of causing the processor to randomly select at least one variation of card delivery steps selected from the group consisting of:

a) a number of playing cards defining a hand of playing cards delivered to the delivery tray, b) at least one hand in which a random number of playing cards will be provided, c) when random numbers of playing cards in at least one of player hands, common cards and a dealer hand are provided, d) whether at least one player hand or dealer hand will receive a random number of playing; cards, and e) a frequency at which random numbers of playing cards will be provided to at least one hand.

5. The apparatus of claim 4, wherein a program, when activated, causes the processor to randomly select a number of playing cards from within a defined range that will be provided to at least one hand in the casino table card game.

6. The apparatus of claim 4, wherein a program, when activated, causes the processor to randomly select a hand that is to contain a random number of playing cards.

7. The apparatus of claim 4, wherein a program, when activated, causes the processor to randomly select a hand that is to contain a random number of cards from within a predetermined range of numbers of playing cards.

8. The apparatus of claim 7, wherein the program, when activated, causes the processor to allow only player hands to be selected to contain a random number of playing cards.

9. The apparatus of claim 7, wherein the program, when activated, causes the processor to allow only a dealer's hand to be selected to contain a random number of playing cards.

10. The apparatus of claim 7, wherein the program, when activated, causes the processor to allow only a hand to contain a random number of cards that is selected from the group consisting of a player's hand, a dealer's hand, community cards and both a player's hand and a dealer's hand.

11. An apparatus for randomizing playing cards and forming hands of playing cards comprising:

a receiving area for a first set of playing cards;

a randomization area wherein the first set of cards is to be randomized;

a processor for controlling playing card movement at least within the randomization area; and a delivery tray where individual hands of playing cards are to be delivered or formed;

wherein multiple dealing programs are present in the processor and at least one program, when activated, causes the processor to randomly select a number of playing cards to be delivered or formed within the delivery tray.

12. The apparatus of claim 11, wherein the at least one program, when activated, causes the processor to instruct the apparatus to form multiple hands wherein at least one hand has a card count unequal to a card count in at least one other hand.

13. The apparatus of claim 11, wherein the number of cards randomly selected by the processor when the at least one program is activated is randomly selected from within a predetermined range.

14. The apparatus of claim 13, wherein only player hands are to be formed in or delivered to the delivery tray.

15. The apparatus of claim 13, wherein only player hands and dealer's hands are formed in or delivered to the delivery tray.

16. A method of providing hands of physical playing cards for use in a casino table card game comprising:

a) providing a first group of physical playing cards into a shuffling apparatus having a processor programmed to control the movement of physical playing cards within the shuffling apparatus;

b) randomizing the first group of cards with the shuffling apparatus;

c) forming individual subgroups of randomized physical playing cards with the shuffling apparatus;

d) moving at least some of the individual subgroups of randomized physical playing cards with the shuffling apparatus to a delivery tray of the shuffling apparatus to provide hands of a number of the randomized physical playing cards; and e) delivering individual hands of the randomized physical playing cards to individual player locations on a casino game table; wherein the number of randomized cards in the individual subgroups moved to the delivery tray of the shuffling apparatus corresponding to at least one hand during a round of play of the casino table card game is randomly determined by the processor in the shuffling apparatus.

17. The method of claim 16, wherein the number of randomized cards in the individual subgroups moved to the delivery tray of the apparatus corresponding to the at least one hand is randomly determined from within a predetermined range of a number of cards.

18. The method of claim 16, wherein an underlying game play procedure in the casino table card game is played with players using a specific number of cards to form poker-type hands, and the number of randomized cards to be randomly determined by the processor is selected from the group consisting of the specific number of cards, fewer than the specific number of cards, and more than the specific number of cards.

19. The method of claim 16, wherein an underlying game play procedure in the casino table card game is played with players using a specific number of cards to form poker-type hands, and the number of randomized cards to be randomly determined by the processor is selected from the group consisting of the specific number of cards, fewer than the specific number of cards, and more than the specific number of cards.

20. The method of claim 16, wherein an underlying game play procedure in the casino table card game is played with players using a specific number of cards to form poker-type hands, and the number of randomized cards to be randomly determined is selected from the group consisting of three cards, four cards, five cards, six cards, and seven cards.

* * * * *

UNITED STATES PATENT AND TRADEMARK OFFICE

CERTIFICATE OF CORRECTION

PATENT NO. : 8,267,404 B2
APPLICATION NO. : 11/895215
DATED : September 18, 2012
INVENTOR(S) : Attila Grauzer and Roger M. Snow It is certified that error appears in the above-identified patent and that said Letters Patent is hereby corrected as shown below:

In the specification:

| | | |
|---|---|---|
| COLUMN 3, | LINE 42, | change "2003/007143A1" to --2003/0071413 A1-- |
| COLUMN 13, | LINE 14, | change "or 9 of cards," to --or 9 cards,-- |
| COLUMN 15, | LINE 30, | change "block keep" to --block **68** keep-- |
| COLUMN 17, | LINE 13, | change "shelf plates" to --shelf pieces-- |
| COLUMN 20, | LINE 46, | change "mechansim **34**" to --mechanism **34**-- |
| COLUMN 22, | LINE 66, | change "three card-hands" to --three-card hands-- |
| COLUMN 27, | LINE 50, | change "and turn …" to --and turn alarm light on/off-- |

In the claims:

| | | | |
|---|---|---|---|
| CLAIM 4, | COLUMN 28, | LINE 34, | change "playing; cards," to --playing cards,-- |

Signed and Sealed this
Sixth Day of October, 2015

Michelle K. Lee

Michelle K. Lee
*Director of the United States Patent and Trademark Office*